US008871417B2

(12) United States Patent
Miki et al.

(10) Patent No.: US 8,871,417 B2
(45) Date of Patent: Oct. 28, 2014

(54) TONER, IMAGE FORMING APPARATUS, AND PROCESS CARTRIDGE

(75) Inventors: Tomoharu Miki, Osaka (JP); Takuya Kadota, Hyogo (JP); Yoshihiro Mikuriya, Hyogo (JP); Tsuyoshi Nozaki, Osaka (JP); Atsushi Yamamoto, Shizuoka (JP); Yoshimichi Ishikawa, Hyogo (JP); Tomohiro Fukao, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 598 days.

(21) Appl. No.: 12/870,433

(22) Filed: Aug. 27, 2010

(65) Prior Publication Data

US 2011/0053071 A1 Mar. 3, 2011

(30) Foreign Application Priority Data

Aug. 28, 2009 (JP) ..... 2009-198071

(51) Int. Cl.

| | |
|---|---|
| ***G03G 9/00*** | (2006.01) |
| ***G03G 15/08*** | (2006.01) |
| ***G03G 21/16*** | (2006.01) |
| ***G03G 9/093*** | (2006.01) |

(52) U.S. Cl.

CPC ..... *G03G 9/09321* (2013.01); *G03G 9/09371* (2013.01); *G03G 9/09364* (2013.01); *G03G 9/09392* (2013.01); *G03G 15/08* (2013.01)

USPC ..... 430/110.2; 430/105; 430/108.4; 430/108.21; 399/262; 399/111; 399/252

(58) Field of Classification Search

CPC ..... G03G 9/093; G03G 9/09307; G03G 9/09342; G03G 9/09357; G03G 9/09364

USPC ..... 430/110.2, 105, 108.4, 108.21; 399/262, 111, 252

See application file for complete search history.

(56) References Cited

U.S. PATENT DOCUMENTS

| | | | |
|---|---|---|---|
| 7,550,242 | B2 | 6/2009 | Nozaki et al. |
| 7,556,904 | B2 | 7/2009 | Kadota et al. |

(Continued)

FOREIGN PATENT DOCUMENTS

| | | |
|---|---|---|
| JP | 2005-173202 | 6/2005 |
| JP | 2007-3840 | 1/2007 |

(Continued)

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

To provide a toner comprising: a binder resin, a colorant, and a releasing agent, wherein the toner has a core shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

where, 'n' is 2 or 3, 'X' is any of 0 to 9, $R_1$ is a hydrogen atom, or an alkyl group, and $R_2$ is a hydrogen atom, an alkyl group, or a phenyl group.

11 Claims, 4 Drawing Sheets

SEM photograph of Example 1

(56) References Cited

U.S. PATENT DOCUMENTS

| | | | | |
|---|---|---|---|---|
| 7,556,906 | B2 | 7/2009 | Katoh et al. | |
| 7,587,159 | B2 | 9/2009 | Fuwa et al. | |
| 7,632,619 | B2 | 12/2009 | Mikuriya et al. | |
| 7,635,549 | B2 | 12/2009 | Nakamura et al. | |
| 7,678,522 | B2 | 3/2010 | Nakamura et al. | |
| 7,695,885 | B2 | 4/2010 | Yasunaga et al. | |
| 7,709,171 | B2 | 5/2010 | Yamamoto et al. | |
| 7,720,428 | B2 | 5/2010 | Hagi et al. | |
| 7,727,694 | B2 | 6/2010 | Murakami et al. | |
| 7,749,671 | B2 | 7/2010 | Yamamoto et al. | |
| 2003/0165758 | A1* | 9/2003 | Urabe | 430/106.1 |
| 2007/0026335 | A1 | 2/2007 | Yamamoto et al. | |
| 2007/0148568 | A1 | 6/2007 | Kadota et al. | |
| 2007/0166635 | A1 | 7/2007 | Yamamoto et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0218384 | A1 | 9/2007 | Matsumoto et al. | |
| 2007/0218388 | A1 | 9/2007 | Kurose et al. | |
| 2007/0218390 | A1 | 9/2007 | Nozaki et al. | |
| 2007/0218393 | A1 | 9/2007 | Nozaki et al. | |
| 2007/0238042 | A1 | 10/2007 | Yasunaga et al. | |
| 2008/0063957 | A1 | 3/2008 | Murakami et al. | |
| 2008/0069608 | A1 | 3/2008 | Katoh et al. | |
| 2008/0069617 | A1 | 3/2008 | Matsumoto et al. | |
| 2008/0070149 | A1 | 3/2008 | Kato et al. | |
| 2008/0076054 | A1* | 3/2008 | Nozaki et al. | 430/110.2 |
| 2008/0081273 | A1 | 4/2008 | Murakami et al. | |
| 2008/0096119 | A1 | 4/2008 | Yamamoto et al. | |
| 2008/0101823 | A1 | 5/2008 | Katoh et al. | |
| 2008/0124635 | A1 | 5/2008 | Nakamura et al. | |
| 2008/0131797 | A1 | 6/2008 | Ishikawa et al. | |
| 2008/0153018 | A1 | 6/2008 | Mikuriya et al. | |
| 2008/0159777 | A1 | 7/2008 | Fuwa et al. | |
| 2008/0175630 | A1 | 7/2008 | Yasunaga et al. | |
| 2008/0176159 | A1 | 7/2008 | Matsumoto et al. | |
| 2008/0220357 | A1 | 9/2008 | Nozaki et al. | |
| 2008/0226356 | A1 | 9/2008 | Yasunaga et al. | |
| 2008/0227001 | A1 | 9/2008 | Kadota et al. | |
| 2008/0227009 | A1 | 9/2008 | Fuwa et al. | |
| 2008/0227013 | A1 | 9/2008 | Kadota et al. | |
| 2008/0227016 | A1 | 9/2008 | Nozaki et al. | |
| 2008/0232857 | A1 | 9/2008 | Matsumoto et al. | |
| 2008/0233497 | A1 | 9/2008 | Yamamoto et al. | |
| 2008/0233506 | A1 | 9/2008 | Hagi et al. | |
| 2008/0233510 | A1 | 9/2008 | Nozaki et al. | |
| 2008/0233511 | A1 | 9/2008 | Ishikawa et al. | |
| 2008/0279591 | A1 | 11/2008 | Yasunaga et al. | |
| 2009/0017391 | A1 | 1/2009 | Yamamoto et al. | |
| 2009/0041511 | A1 | 2/2009 | Fuwa et al. | |
| 2009/0052952 | A1 | 2/2009 | Katoh et al. | |
| 2009/0117481 | A1 | 5/2009 | Yasunaga et al. | |
| 2009/0169270 | A1 | 7/2009 | Fuwa et al. | |
| 2009/0186289 | A1 | 7/2009 | Nakamura et al. | |
| 2009/0186291 | A1 | 7/2009 | Mikuriya et al. | |
| 2009/0220879 | A1 | 9/2009 | Matsumoto et al. | |
| 2009/0232542 | A1 | 9/2009 | Yamamoto et al. | |
| 2009/0233199 | A1 | 9/2009 | Nozaki et al. | |
| 2009/0257792 | A1 | 10/2009 | Nakamura et al. | |
| 2009/0297975 | A1 | 12/2009 | Ishikawa et al. | |
| 2009/0297976 | A1 | 12/2009 | Yamamoto et al. | |
| 2010/0009282 | A1 | 1/2010 | Katoh et al. | |
| 2010/0055595 | A1* | 3/2010 | Shirai et al. | 430/109.4 |
| 2010/0055603 | A1 | 3/2010 | Nozaki et al. | |
| 2010/0068646 | A1 | 3/2010 | Yamamoto | |
| 2010/0150609 | A1 | 6/2010 | Nozaki et al. | |

FOREIGN PATENT DOCUMENTS

| | | |
|---|---|---|
| JP | 2007-71965 | 3/2007 |
| JP | 2007-93809 | 4/2007 |

* cited by examiner

SEM photograph of Example 1

SEM photograph of Comparative Example 1

TONER, IMAGE FORMING APPARATUS, AND PROCESS CARTRIDGE

BACKGROUND OF THE INVENTION

1. Field of the Invention

The present invention relates to a toner for dry electrostatic charge image development which is used for developing an electrostatic latent image formed in processes of electrophotography, electrostatic recording, and electrostatic printing, and also relates to an image forming apparatus using such toner, and a process cartridge using such toner.

2. Description of the Related Art

In the field of electrophotography, heretofore, research and development has been carried out using various inventive processes and technological approaches. In electrophotography, a surface of a photoconductor is charged, the charged surface of the photoconductor is exposed to light to form an electrostatic latent image, the resultant electrostatic latent image is developed with a toner having a color to form an toner image, and the resultant toner image is transferred to a medium such as transfer paper, then the transferred toner image is fixed with a heat roller, and the like to form an image.

For a method of fixing a toner, a contact heat fixing method, such as a fixing method using a heat roller, is widely employed. Fixing devices used in the heat roller fixing method are equipped with a heat roller and a pressure roller, and used for thermofusing and fixing toner images onto a recording sheet by feeding the recording sheet, on which the toner image has been transferred, through a pressure welding part (a nip portion) between the heat roller and the pressure roller.

Examples of resins used in toners mainly include vinyl polymerization resins and resins having polyester backbones. Recently, also so-called hybrid resins having both types of backbones of the above two resins, in which the above two types of resins are combined for use, are used, because the above two types of resins have advantages over each other and disadvantages compared to each other with respect to functional characteristics of toners, such as flowability, mobility, electrostatic chargeability, fixing ability, and image characteristics. Examples of a method for producing toners include, in addition to a so-called kneading pulverizing method which has been conventionally used, a production method called a wet granulation method or a chemical toner method, such as a suspension method and an emulsification method which uses an organic solvent with a water-based solvent; a suspension polymerization method in which polymerizable monomer droplets are controlled for polymerization to directly obtain toner particles; and an agglutination method in which fine emulsified particles are prepared and agglutinated to obtain toner particles.

In the above-mentioned contact fusing method, the heating temperature is set as low as possible for saving energy for consumption in the equipment. Therefore, resins for use in toners used in such equipment are preferably resins which melt at low temperatures. In an electrophotographic process, however, there are steps in which mechanical stress or thermal stress is exerted on such toners. Thus, the resins for use in such toners must meet requirements of thermal properties, such as glass transition temperature, for preventing blocking, and the like and requirements of molecular weights for preventing toner cracking. Lowering the heating temperatures and meeting the above two requirements are two desirable but incompatible features, thus it is important to achieve an excellent trade-off between the two features for developing such toners. From the viewpoint of achieving such an excellent trade-off, a known, so-called core/shell type toner has been proposed, which contains a resin having favorable thermal fusing ability inside covered by a resin having favorable preventability of blocking outside, and which is designed to contain polyester resins and styrene-acrylate resins for core materials (see Japanese Patent Application Laid-Open (JP-A) Nos. 2006-285188 and 2007-093809).

Although polyester resins have excellent low-temperature fixing ability, they have poor dispersibility of releasing agents. Furthermore, although styrene-acrylate resins have excellent dispersibility of releasing agents, they don't have good low-temperature fixing ability. Thus at present, it is desired that a hybrid resin, which may achieve favorable dispersibility of releasing agents while achieving favorable low-temperature fixing ability, be used for a core material in the toner. Although, in recent years many researchers have undertaken the work for developing a shell for the core containing the hybrid resin, it is found that it takes a long time period to unify the core and the shell by heating, requiring considerable load which must be applied to the environment of the unification process (JP-A No. 2007-003840).

BRIEF SUMMARY OF THE INVENTION

An object of the present invention is to provide a toner for dry electrostatic image development, an image forming apparatus, and a process cartridge, wherein the toner contains a core containing a hybrid resin including a vinyl copolymer unit having relatively high miscibility with releasing agents and a polyester unit having high miscibility with polyesters, and contains a shell suitable for use with the hybrid resin, and thereby the toner provides excellent releasing ability, charging ability, and durability, achieving readiness with which the core and the shell may be unified at normal temperature which readiness is realized by forming the shell while shell materials are dispersed in an organic solvent, resulting in a shell having high strength.

As a result of earnest studies carried out by the present inventors for solving the above problems, the present inventors found that when a hybrid resin is used for a core material to increase dispersibility of a releasing agent and to be able to evenly charge the core and when a shell material, which may be evenly applied on the core that may contain a hybrid resin, is developed, the above problems may be solved, and according to these findings the present invention has been accomplished.

The present invention is based on the above findings by the present inventors, and means for solving the above problems are as follows:

<1> A toner containing:

a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

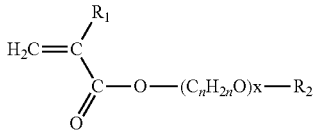

where, 'n' is 2 or 3, 'X' is any of 0 to 9, $R_1$ is a hydrogen atom, or an alkyl group, and $R_2$ is a hydrogen atom, an alkyl group, or a phenyl group.

<2> The toner according to <1>, wherein in General Formula (1) $R_1$ and $R_2$ are each the hydrogen atom or the alkyl group, 'n' is 2, and 'X' is any of 2 to 9.

<3> The toner according to <1>, wherein the resin contained in the shell contains 65% by mass to 85% by mass of a styrene monomer and 15% by mass to 35% by mass of an ester monomer based on the total amount of monomers in the resin, and the total amount of the styrene monomer and the ester monomer is 80% by mass to 100% by mass based on the total amount of the monomers in the resin.

<4> The toner according to <1>, wherein the resin contained in the shell contains 70% by mass to 80% by mass of a styrene monomer and 20% by mass to 30% by mass of an ester monomer based on the total amount of monomers in the resin, and the total amount of the styrene monomer and the ester monomer is 90% by mass to 100% by mass based on the total amount of the monomers in the resin.

<5> The toner according to <1>, wherein the core contains the hybrid resin or a resin mixture of the hybrid resin and the polyester resin.

<6> The toner according to <1>, wherein the hybrid resin contains a styrene resin in an amount of 5% by mass to 25% by mass based on the total amount of the hybrid resin during synthesis thereof.

<7> The toner according to <1>, wherein the hybrid resin contains a styrene resin in an amount of 10% by mass to 20% by mass based on the total amount of the hybrid resin during synthesis thereof.

<8> The toner according to <1>, wherein the core further contains a polyester resin modified with at least one of a urethane group and a urea group, in addition to the resin having a polyester backbone.

<9> The toner according to <1>, wherein the releasing agent contains at least one selected from the group consisting of paraffin, synthetic polyester, polyolefin, carnauba wax, and rice wax.

<10> A toner container containing:

a container, and a toner housed in the container, wherein the toner contains a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

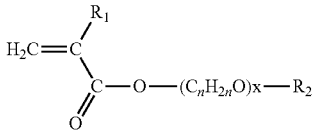

where, 'n' is 2 or 3, 'X' is any of 0 to 9, $R_1$ is a hydrogen atom, or an alkyl group, and $R_2$ is a hydrogen atom, an alkyl group, or a phenyl group.

<11> A developer containing:

a toner, wherein the toner is a toner which contains a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

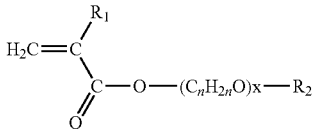

where, 'n' is 2 or 3, 'X' is any of 0 to 9, $R_1$ is a hydrogen atom, or an alkyl group, and $R_2$ is a hydrogen atom, an alkyl group, or a phenyl group.

<12> A developing device containing:

a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner comprising a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

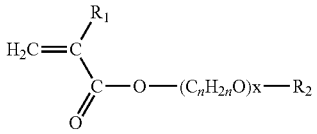

where, 'n' is 2 or 3, 'X' is any of 0 to 9, $R_1$ is a hydrogen atom, or an alkyl group, and $R_2$ is a hydrogen atom, an alkyl group, or a phenyl group.

<13> A process cartridge containing:

a latent image bearing member, and a developing device configured to develop a latent image formed on the latent image bearing member with a developer, wherein the latent image bearing member is integrated with at least the developing device so as to form the process cartridge which is detachably mounted on an image forming apparatus, wherein the developing device contains, a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner comprising a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

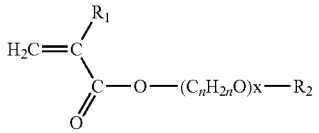

where, 'n' is 2 or 3, 'X' is any of 0 to 9, $R_1$ is a hydrogen atom, or an alkyl group, and $R_2$ is a hydrogen atom, an alkyl group, or a phenyl group.

<14> An image forming apparatus containing, a latent image bearing member configured to bear a latent image on a surface thereof, a charging unit configured to evenly charge the surface of the latent image bearing member, an exposing unit configured to expose the charged surface of the latent image bearing member to light based on an image data so as to write the latent electrostatic image thereon, a developing device configured to supply a toner to the latent electrostatic image formed on the surface of the latent image bearing member so as to visualize the latent electrostatic image, a transfer unit configured to transfer the resultant visible image formed on the surface of the latent image bearing member to a medium, and a fixing unit configured to fix the resultant visible image on the medium, wherein the developing device contains, a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner comprising a binder resin, a colorant, and a releasing agent, wherein the toner has a core-shell structure, and wherein the core contains at least one resin selected from the group consisting of a hybrid resin and a polyester resin, where the hybrid resin is a resin in which a polyester resin and a vinyl resin are chemically bonded to each other, and the shell contains a resin prepared by polymerizing at least a styrene monomer and an ester monomer represented by the following General Formula (1):

General Formula (1)

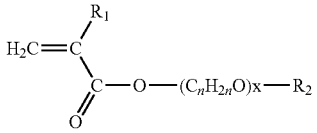

where, 'n' is 2 or 3, 'X' is any of 0 to 9, $R_1$ is a hydrogen atom, or an alkyl group, and $R_2$ is a hydrogen atom, an alkyl group, or a phenyl group.

A hybrid resin is used for a core material of a toner according to the present invention, which may result in improvement of the dispersibility of a releasing agent inside a toner and of the evenness of charge on the surface of the toner. Furthermore, a resin prepared by polymerizing styrene and an ester monomer represented by the above General Formula (1) may be used for a shell material of the toner of the present invention. Then, it becomes possible to allow the shell material to adhere to the surface of a core containing an organic solvent, which results in achievement of easy unification of the core and the shell at normal temperatures, and in turn in improvement of durability of the toner. Particularly when a hybrid resin is incorporated in a shell material used in the present invention, the resultant shell material may be very effective in forming an even coating over the surface of the core.

The toner according to the present invention includes at least a binder resin, a colorant, and a releasing agent. Further, when a resin is produced for a shell material by polymerizing an ester monomer represented by the General Formula (1) with a styrene monomer, 'n' is one of 2 and 3, X is any of 0 to 9, $R_1$ is one of a hydrogen atom and an alkyl group, and $R_2$ is any one of a hydrogen atom, an alkyl group, and a phenyl group.

In the General Formula (1), $R_1$ and $R_2$ are each preferably the hydrogen atom or the alkyl group, particularly preferably the alkyl group; 'n' is particularly preferably 2; X is preferably 2 to 9, and particularly preferably 2.

The amount of a styrene component, used as a sort of vinyl resin, in the hybrid resin is preferably 5% by mass to 25% by mass, and more preferably 10% by mass to 20% by mass. When the amount of the styrene resin is 25% by mass or less in the hybrid resin, it is possible to prevent the dispersion diameter of the polystyrene in the polyester resin from becoming extremely small and in turn to prevent the dispersion particle diameter of a wax from becoming extremely small, making the wax exert adequate effects in the toner. When the amount of the styrene resin is 5% by mass or more in the hybrid resin, it is possible to prevent the polystyrene component from dispersing very sparsely in the polystyrene resin, making effects of the hybrid resin, such as enhancement of dispersibility of a wax, adequate.

The amounts of a styrene monomer, an ester monomer, and the total of the styrene monomer and the ester monomer, in the shell are, respectively, 65% by mass to 85% by mass, 15% by mass to 35% by mass, and 80% by mass to 100% by mass. When the resin for the shell is prepared by polymerizing an ester monomer represented by the General Formula (1) in addition to styrene, the shell becomes polar by incorporation of the resin therewithin, thereby enhances the adherence of the shell to the core, and may form an even coating on the core, which could not be realized by polystyrene.

According to the present invention, problems of conventional art may be solved, and the dispersibility of a releasing agent inside a toner is improved by using a hybrid resin, in a core of the toner, including a vinyl copolymer unit having relatively high miscibility with the releasing agent and a polyester unit having high miscibility with polyester. Furthermore, the core may be evenly coated with a shell material of the present invention, which improves the charging ability and the durability of the toner, prevents blade adhesion, may provide a favorable toner which does not cause noise of images, such as filming and background fogging, and, as a result, may produce high quality images.

DETAILED DESCRIPTION OF THE INVENTION (Toner)

Figure 1A:
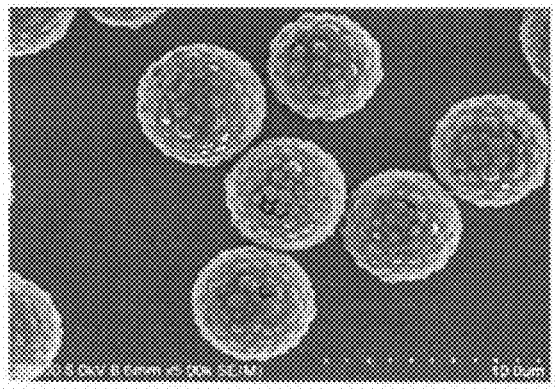
FIG. 1A is a SEM photograph of a toner having a core shell structure of Example 1.

A toner of the present invention includes at least a binder resin, a colorant, and a releasing agent, and, further, an additional component as required.

The toner of the present invention has a core shell structure.

<Core Shell Structure>

The method for producing the toner of the present invention is a method for producing an electrostatic image developing toner, including, at least, forming core particles by dissolving or dispersing, at least, a hybrid resin or a polyester resin, a colorant, and a releasing agent in an organic solvent and, then, by dispersing the resultant solution or dispersion in a water-based medium, and coating the core particles with fine particles of a vinyl copolymer resin by adding a water-based dispersion, in which at least fine particles of a vinyl copolymer resin is dispersed, to the resultant dispersion of the solution or the dispersion in a water-based medium, wherein the fine particles of a vinyl copolymer resin may be added to the dispersion of the core particles from which an organic solvent has been removed, or added to the dispersion of the core particles containing an organic solvent. The present invention provides an electrostatic image developing toner which achieves favorable low-temperature fixing ability while achieving favorable heat resistance storage ability, is excellent in offset resistance, may have a controllable toner structure, does not contaminate a developing device, and the like, and produces a favorable amount of charge on the surface of the toner.

<Core>

In order to evenly disperse a releasing agent in a polyester component, most preferably, a component having relatively high miscibility with the releasing agent is evenly predispersed in the polyester component, and the releasing agent is allowed to disperse in the component. Before now, the present inventors found that, when a particular polyester component having low miscibility with a releasing agent and a vinyl component having intermediate miscibility, as a releasing agent, with polyester are premixed, in an appropriate mix ratio, in a polyester component, it becomes possible to evenly disperse the vinyl component in the polyester component and to evenly disperse a releasing agent in the vinyl component.

The above releasing agent may be evenly microdispersed in an area under the surface of a toner, and thus may rapidly exude to the surface of the toner during fixing, which may satisfy the requirement of excellent performance of toner fixing, prevents the releasing agent from being discharged from the toner, and may produce high quality images. An ideal structure of the toner can be viewed as an "islands-in-the-sea" structure in which a vinyl component represents islands dispersed in the sea of a polyester resin, and, importantly, a releasing agent represent isles gathering around the shore of islands of the vinyl component according to the nature of the polyester resin, the vinyl component, and the releasing agent. Therefore, the dispersibility of particles of the releasing agent which gather around particles of the vinyl component may necessarily be determined and enhanced by the amount of the vinyl component to be dispersed in the polyester resin component, which amount may be controlled to an optimum for producing a favorable toner.

[Hybrid Resin]

—Polyester Resin Containing a Low Molecular Weight Vinyl Component—

The binder resin may include a polyester resin modified with a polyvinyl component in which the polyvinyl component is incorporated in a polyester molecule. The glass transition temperature (Tg) of the binder resin is preferably 40° C. or higher. When the Tg is 40° C. or higher, the binder resin provides favorable heat resistance/storage ability such that requirements of the present invention are satisfied. When the Tg is higher than 75° C., low-temperature fixing performance of the toner may be impaired. Known polyester resins, such as an unmodified polyester prepared by polymerizing a polyhydric carboxylic acid and a polyhydric alcohol, and a urethane- and/or urea-modified polyester resin prepared from a polyester prepolymer having an isocyanate bond, may be used, alone or in combination, for producing the vinyl component-modified polyester.

Preferably a resin having both a polyester resin unit (a noncrystalline polycondensation polymer unit) and a vinyl resin unit (a radical polymerization polymer unit) in the molecular backbone thereof may be used for a modified polyester resin of the present invention, that is a resin modified with both a noncrystalline polycondensation polymer unit and a radical polymerization polymer unit in the molecular backbone thereof, wherein the resin having both a polyester resin unit and a vinyl resin unit is prepared by a process including mixing a raw monomer of the polyester resin unit, a raw monomer of the vinyl resin unit, and an additional monomer capable of reacting with both raw monomers of the polyester resin unit and the vinyl resin unit, and subjecting the resultant mixture to polycondensation and radical polymerization at the same time in the same container. Note that the additional monomer capable of reacting with both raw monomers of the polyester resin unit and the vinyl resin unit is, in other words, a monomer which is reactive in both polycondensation and radical polymerization, that is a monomer having a carboxylic group, which is reactive in polycondesation, and a vinyl group, which is reactive in radical polymerization; examples of such monomers include fumaric acid, maleic acid, acrylic acid, and methacrylic acid.

Examples of a raw monomer of the vinyl polyester resin include, as mentioned above, a polyhydric alcohol and a polyhydric carboxylic acid.

Examples of a raw monomer of the radical polymerization polymer unit (vinyl resin unit) include styrene or derivatives thereof, such as styrene, o-methyl styrene, m-methyl styrene, p-methyl styrene, α-methyl styrene, p-ethyl styrene, 2,4-dimethylstyrene, p-tert-butyl styrene, and p-chlorostyrene; unsaturated hydrocarbons of ethylene series (monoolefins), such as ethylene, propylene, butylene, and isobutylene; methacrylic acid alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-methylbutyl methacrylate, hexyl methacrylate, octyl methacrylate, nonyl methacrylate, decyl methacrylate, undecyl methacrylate, and dodecyl methacrylate; acrylic acid alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-methylbutyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid, and maleic acid: acrylonitrile, maleic acid esters, itaconic acid esters, vinyl chloride, vinyl acetate, vinyl benzoate, vinyl methyl ethyl ketone, vinyl hexyl ketone, vinyl methyl ether, vinyl ethyl ether, and vinyl isobutyl ether.

Examples of a polymerization initiator for polymerizing a raw monomer of the radical polymerization polymer unit (vinyl resin unit) include azo polymerization initiator or diazo polymerization initiator, such as 2,2'-azobis (2,4-dimethylvaleronitrile), 2,2'-azobis (isobutyronitrile), 1,1'-azobis (cyclohexane-1-carbonitrile), and 2,2'-azobis-4-methoxy-2,4-dimethylvaleronitrile); peroxide polymerization initiators such as benzoyl peroxide, dicumyl peroxide, methyl ethyl ketone peroxide, isopropyl peroxide carbonate, and lauroyl peroxide.

—Polyester Resin—

Examples of the polyester resin used in the present invention include a polycondensate of a polyhydric alcohol (1) and a polyhydric carboxylic acid (2), which are described below. Any polycondensate of a polyhydric alcohol (1) and a polyhydric carboxylic acid (2) and also a mixture of several polyester resins may be used in the present invention.

—Polyhydric Alcohols—

The polyhydric alcohol (1) is not particularly limited and may be appropriately selected depending on the purpose; examples thereof include alkylene glycols such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, bisphenol S; 4,4'-dihydroxybiphenyl-based compounds such as 3,3'-difluoro-4,4'-dihydroxybiphenyl; bis (hydroxyphenyl) alkanes such as bis (3-fluoro-4-hydroxyphenyl)methane, 1-phenyl-1,1-bis(3-fluoro-4-hydroxyphenyl)ethane, 2,2-bis (3-fluoro-4-hydroxyphenyl) propane, 2,2-bis (3,5-difluoro-4-hydroxyphenyl) propane (also called tetrafluorobisphenol A), and 2,2-bis(3-hydroxyphenyl)-1,1,1,3,3,3-hexafluoropropane; bis (4-hydroxyphenyl)ether-based compounds such as bis (3-fluoro-4-hydroxyphenyl)ether; alkylene oxide adducts of the above alicyclic diols, such as ethylene oxide adducts, propylene oxide adducts, and butylene oxide adducts of the above alicyclic diols; and alkylene oxide adducts of the above bisphenols, such as ethylene oxide adducts, propylene oxide adducts, and butylene oxide adducts of the above bisphenols.

Among these polyhydric alcohols, the polyhydric alcohol (1) for use in the present invention is preferably an alkylene glycol having 2 to 12 carbon atoms and an alkylene oxide adduct of a bisphenol, and particularly preferably an alkylene oxide adduct of a bisphenol and a combination of an alkylene oxide adduct of a bisphenol and an alkylene glycol having 2 to 12 carbon atoms.

Examples of the polyhydric alcohol (1) further include trihydric to octahydric or more polyhydric aliphatic alcohols such as glycerin, trimethylol ethane, trimethylol propane, pentaerythritol, and sorbitol; trihydric or more phenols such as tris phenol PA, phenol novolac, and cresol novolac; and alkylene oxide adducts of the above-mentioned trihydric or more polyphenols.

Note that the polyhydric alcohol (1) may be used alone or in combination, and may not be limited to the above examples.

—Polyhydric Carboxylic Acid—

The above-mentioned polyhydric carboxylic acid (2) is not particularly limited and may be appropriately selected depending on the intended purpose; examples thereof include alkylene dicarboxylic acids such as succinic acid, adipic acid, and sebacic acid; alkenylene dicarboxylic acids such as maleic acid, and fumaric acid; aromatic dicarboxylic acids such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride.

Among these polyhydric carboxylic acids, particularly preferably an alkenylene dicarboxylic acid having 4 to 20 carbon atoms and an aromatic dicarboxylic acid having 8 to 20 carbon atoms are used for the polyhydric carboxylic acid (2) of the present invention. Furthermore, a trihydric or more carboxylic acid, for example, an aromatic polyhydric carboxylic acid having 9 to 20 carbon atoms, such as trimellitic acid and pyrromellitic acid, or anhydrides thereof or lower alkyl esters (such as methyl esters, ethyl esters, and isopropyl esters) thereof may be used for reacting with the polyhydric alcohol (1).

Note that the polyhydric carboxylic acid (2) may be used alone or in combination, and may not be limited to the above examples.

—Mixing Ratio of Polyhydric Alcohol and Polyhydric Carboxylic Acid—

A mixing ratio of the polyhydric alcohol (1) and the polyhydric carboxylic acid (2), quantified as an equivalent ratio ([OH]/[COOH]) of hydroxyl groups [OH] to carboxylic groups [COOH] is preferably 2/1 to 1/1, more preferably 1.5/1 to 1/1, and further preferably 1.3/1 to 1.02/1.

—Molecular Weight of Polyester Resin—

Peak molecular weight of the polyester resin is preferably within the range of 1,000 to 30,000, more preferably within the range of 1,500 to 10,000, and further preferably within the range of 2,000 to 8,000. When the polyester resin has peak molecular weight of lower than 1,000, heat resistance storage ability of the toner may be degraded. When the polyester resin has peak molecular weight of higher than 30,000, low temperature fixing ability of the toner may be degraded.

—Modified Polyester Resin—

In order to adjust the viscoelasticity, the binder resin used in the present invention may contain a polyester resin modified with at least one of a urethane group and a urea group. The amount of the polyester resin modified with at least one of a urethane group and a urea group is preferably 20% by mass or less, more preferably 15% by mass or less, and further preferably 10% by mass or less, based on the amount of the binder resin. When the amount of the polyester resin modified with at least one of a urethane group and a urea group is more than 20% by mass, low-temperature fixing ability of the toner may be degraded.

The polyester resin modified with at least one of a urethane group and a urea group may be directly mixed with the binder resin. However, from the view point of manufacturability, preferably the polyester resin modified with at least one of a urethane group and a urea group is incorporated into the binder resin by a process including mixing, in a binder resin, a relatively low-molecular weight polyester resin modified with an isocyanate group at the termini thereof (hereinafter, may be called "prepolymer"), and an amine capable of reacting with the relatively low-molecular weight polyester resin, subjecting the resultant mixture to granulation, and, during and/or after the granulation, subjecting the granulated mixture to a chain propagation reaction and/or a cross-linking reaction to form the polyester resin modified with at least one of a urethane group and a urea group of the present invention. When the above process is used, it becomes easy to incorporate a relatively high molecular weight modified polyester resin into the binder resin for adjusting the viscoelasticity thereof.

—Prepolymer—

Examples of the prepolymer having an isocyanate group include a product prepared by reacting, further with a polyisocyanate (3), a polyester which is a polycondensate of a polyhydric alcohol (1) and a polyhydric carboxylic acid (2) and which has an active hydrogen group. Examples of the active hydrogen group of the polyester include a hydroxyl group (an alcoholic hydroxyl group and a phenolic hydroxyl group), an amino group, a carboxylic group, and a mercapto group. Among these active hydrogen groups, an alcoholic hydroxyl group is particularly preferable.

—Polyisocyanate—

The polyisocyanate (3) is not particularly limited and may be appropriately selected depending on the intended purpose; examples thereof include aliphatic polyisocyanates such as tetramethylene diisocyanate, hexamethylene diisocyanate, and 2,6-diisocyanatomethylcaproate; alicyclic polyisocyanates such as isophorone diisocyanate, and cyclohexylmethanediisocyanate; aromatic diisocyantes such as tolylene diisocyanate and diphenylmethane diisocyante; aromatic aliphatic diisocyanates such as α,α,α',α'-tetramethyl xylylene diisocyanate; isocyanurates; the polyisocyantes whose isocyanate groups are blocked with a phenol derivative, an oxime, a caprolactam, and the like; and a combination thereof.

—Mixing Ratio of Isocyanate Group and Hydroxyl Group—

A mixing ratio of the polyisocyanate (3) and the polyester, quantified as an equivalent ratio ([NCO]/[OH]) of isocyanate groups [NCO] to hydroxyl groups [OH] of the polyester, is preferably 5/1 to 1/1, more preferably 4/1 to 1.2/1, and further preferably 2.5/1 to 1.5/1. When an equivalent ratio ([NCO]/[OH]) is higher than 5, low-temperature fixing ability of the toner may be degraded. When a molar ratio of the [NCO] is lower than 1, offset resistance of the toner may be degraded because the urea content of the modified polyester is reduced.

The amount of the polyisocyanate (3) component in the prepolymer (A) having an isocyanate group at the termini thereof is preferably 0.5% by mass to 40% by mass, more preferably 1% by mass to 30% by mass, further preferably 2% by mass to 20% by mass. When the amount of the polyisocyanate (3) component in the prepolymer (A) is less than 0.5% by mass, offset resistance of the toner may be degraded. When the amount of the polyisocyanate (3) component in the prepolymer (A) is more than 40% by mass, low-temperature fixing ability of the toner may be degraded.

—Number of Isocyanate Groups in Prepolymer—

Mean number of isocyanate groups per prepolymer (A) molecule having isocyanate groups is preferably 1 or more, more preferably 1.5 to 3, and further preferably 1.8 to 2.5. When the mean number of isocyanate groups per prepolymer (A) molecule having isocyanate groups is less than 1, the molecular weight of the modified polyester after the chain propagation reaction and/or the cross-linking reaction may be reduced and thereby the offset resistance of the toner may be degraded.

—Chain Propagator and/or Crosslinker—

For a chain propagator and/or a crosslinker for prepolymer (A), amines may be used. Examples of the amines (B) include diamines (B1), trihydric or more polyamines (B2), amino alcohols (B3), aminomercaptans (B4), amino acids (B5) and amines of B1 to B5 whose amino groups are blocked (B6).

Examples of diamines (B1) include aromatic diamines, alicyclic diamines, and aliphatic diamines.

Examples of aromatic diamines include phenylenediamine, diethyltoluenediamine, 4,4'-diaminodiphenylmethane, tetrafluoro-p-xylylenediamine, and tetrafluoro-p-phenylenediamine.

Examples of alicyclic diamines include 4,4'-diamino-3,3'-dimethyldicyclohexylmethane, diaminocyclohexane, and isophoronediamine.

Examples of aliphatic diamines include ethylenediamine, tetramethylenediamine, hexamethylenediamine, dodecafluorohexylenediamine, and tetracosafluorodocecylenediamine.

Examples of trivalent or more polyamines (B2) include diethylenetriamine, and triethylenetetraamine.

Examples of amino alcohols (B3) include ethanolamine, and hydroxyethylaniline.

Examples of aminomercaptans (B4) include aminoethylmercaptan, and aminopropylmercaptan.

Examples of amino acids (B5) include aminopropionic acid, and aminocaproic acid.

Examples of amines of B1 to B5 whose amino groups are blocked (B6) include ketimine compounds and oxazoline compounds obtained from amines in (B1) to (B5) and ketones such as acetone, methylethylketone, and methyl isobutyl ketone.

—Chain Terminator—

Furthermore, the chain propagation reaction and/or the cross-linking reaction may be terminated, as required, with a chain terminator, and thereby the molecular weight of the end product of such reaction, i.e., a modified polyester, may be adjusted. Examples of the chain terminators include monoamines such as diethylamine, dibutylamine, butylamine, and laurylamine, or the above monoamines whose amino groups are blocked (ketimine compounds).

—Mixing Ratio of Amino Group and Isocyanate Group—

A mixing ratio of the prepolymer (A) having an isocyanate group to the amine (B), quantified as an equivalent ratio ([NCO]/[NHx]) of the isocyanate group [NCO] in the prepolymer (A) having an isocyanate group to the amino group [NHx] in the amine (B) is preferably 1/2 to 2/1, more preferably 1.5/1 to 1/1.5 and further preferably 1.2/1 to 1/1.2. When the equivalent ratio ([NCO]/[NHx]) is higher than 2 or less than 1/2, the molecular weight of the urea-modified polyester (i) may be reduced and thereby hot offset resistance of the toner may be degraded.

<Colorant>

The colorant is not particularly limited and can be any colorant selected from the known dyes and pigments; examples thereof include carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, zinc flower, lithopone, and a mixture thereof.

The amount of the colorant in the toner is preferably 1% by mass to 15% by mass, and more preferably 3% by mass to 10% by mass.

<Releasing Agent>

The releasing agent used in the present invention is not particularly limited and may be selected from those releasing agents which are known; examples thereof include polyolefin waxes such as polyethylene waxes and polypropylene waxes; long-chain hydrocarbons such as paraffin waxes, Fischer-Tropsch waxes, and Sasol waxes; and carbonyl group-containing waxes. Examples of the carbonyl group containing waxes include polyalkane esters such as carnauba wax, montan wax, trimethylolpropane tribehenate, pentaerythritol tetrabehenate, pentaerythritol diacetate dibehenate, glycerine tribehenate, and 1,18-octadecanediol distearate; polyalkanol esters such as tristearyl trimellitate and distearyl maleate; polyalkanoic acid amides such as ethylenediamine dibehenyl amide; polyalkyl amides such as trimellitic acid tristearyl amide; and dialkyl ketones such as distearyl ketone. In addition, synthetic esters and rice waxes are preferably used for the releasing agent in the present invention. From the view point of low polarity and low melt viscosity, among the above releasing agents, preferably polyolefin waxes and long-chain hydrocarbons, particularly preferably paraffin waxes and Fischer-Tropsch waxes are used for the releasing agent.

<External Additives>

—Fine Inorganic Particle—

For an external additive for promoting flowability, developing ability, and chargeability of a colorant-containing particle obtained in the present invention, a fine inorganic particle is preferably used. The primary particle diameter of the fine inorganic particle is preferably 5 nm to 2 μm, and more preferably 5 nm to 500 nm. The specific surface area of the fine inorganic particle, quantified according to BET method, is preferably 20 $m^2/g$ to 500 $m^2/g$. The amount of the fine inorganic particle for use in the toner is preferably 0.01% by mass to 5% by mass, and more preferably 0.01% by mass to 2.0% by mass.

The fine inorganic particle is not particularly limited and may be appropriately selected depending on the purpose; examples thereof include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

—Fine Polymer Particle—

Examples of the fine polymer particle include polystyrenes that are prepared by soap-free emulsification polymerization, suspension polymerization, dispersion polymerization, and the like; copolymers of methacrylic acid esters and acrylic acid esters; polycondensates such as silicones, benzoguanamine resins, and nylons; and polymer particles of thermosetting resins.

Such fluidizers as mentioned above may be subjected to surface treatment for increasing hydrophobicity thereof and preventing degradation of charging properties of the toner. Examples of preferable surface treatment agents include silane coupling agents, silylation agents, silane coupling agents having a fluorinated alkyl group, organic titanate coupling agents, aluminum coupling agents, silicone oils, and modified silicone oils.

Examples of a cleaning property enhancer that is used for removing a residual developer which has been remained on a photoconductor or on a primary transfer medium after transfer include fatty acid metal salts such as zinc stearate, calcium stearate, and stearic acid salts; and fine polymer particles produced by soap-free emulsification polymerization, such as a fine poly(methyl methacrylate) particle and a fine polystyrene particle. For the fine polymer particle, a fine polymer particle having a relatively narrow particle size distribution and a volume average particle diameter of 0.01 μm to 1 μm is preferably used.

<Shell>

—Shell Prepared by Polymerization of Styrene and Ester Monomer—

Figure 1B:
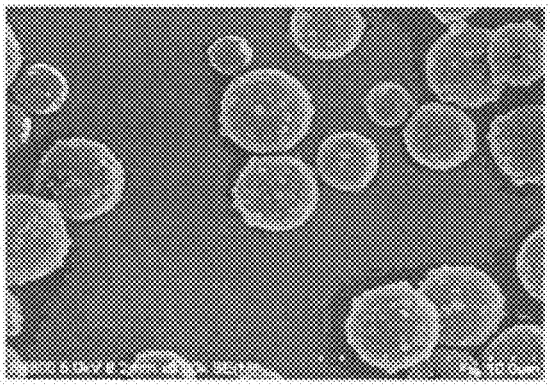
FIG. 1B is a SEM photograph of a toner having a core shell structure of Comparative Example 1.

So far, polyester resins which achieve excellent low-temperature fixing ability while failing to achieve favorable dispersibility of a releasing agent and styrene-acrylic resins which achieve excellent dispersibility of a releasing agent while failing to achieve favorable low-temperature fixing ability has been principally proposed for use in core materials of the toner. However, at present, there is increasing need for a toner in which a hybrid resin which is capable of achieving both excellent dispersibility of a releasing agent and excellent low-temperature fixing ability is used for core material. When a hybrid resin is used for a core material and polystyrene resin are used for a shell material, of a toner, surfaces of cores could not be evenly coated with the shell material, as shown in FIG. 1A (a SEM image of Comparative Example 1). However, it is found in the present invention that when a resin prepared by polymerization of styrene and an ester monomer is used for a shell material of the present invention, the polarity of the shell resin of the present invention is increased, and thereby adherence of the shell resin to a polyester resin is enhanced. Thus, a shell material which can be evenly applied on surfaces of a core even when the core is made of a hybrid resin has been developed in the present invention, as shown in FIG. 1B (a SEM image of Example 1).

[Polymerization of Shell Resin]

—Vinyl Copolymer—

Examples of copolymers of a vinyl monomer include copolymers of any monomers selected from the following monomer groups (1) to (10), wherein copolymers are prepared by polymerizing two or more monomers listed below in any ratio. Examples of such copolymers include styrene-(meth)acrylic acid ester copolymers, styrene-butadiene copolymers, (meth)acrylic acid-acrylic acid ester copolymers, styrene-acrylonitrile copolymers, styrene-maleic anhydride copolymers, styrene-(meth)acrylic acid copolymers, styrene-(meth)acrylic acid-divinylbenzene copolymers, and styrene-styrenesulfonic acid-(meth)acrylic acid ester copolymers.

(1) Vinyl Hydrocarbons:

Aliphatic vinyl hydrocarbons: alkenes such as ethylene, propylene, butene, isobutylene, pentene, heptene, diisobutylene, octene, dodecene, octadecene, and α-olefins other than those mentioned above; alkadienes such as butadiene, isoprene, 1,4-pentediene, 1,6-hexadiene, 1,7-octadiene, and the like.

Alicyclic vinyl hydrocarbons: mono- or di-cycloalkenes and alkadienes such as cyclohexene, (di)cyclopentadiene, vinylcyclohexene, and ethylidenebicycloheptene; terpenes such as pinene, limonene, indene, and the like.

Aromatic vinyl hydrocarbons: styrene and a substituted styrene with a hydrocarbyl (alkyl, cycloalkyl, aralkyl, and/or alkenyl) group such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; vinyl naphthalene, and the like.

(2) Carboxyl group-containing vinyl monomers and salts thereof: unsaturated monocarboxylic acids having 3 to 30 carbon atoms, unsaturated dicarboxylic acids, anhydrides thereof, or monoalkyl (C1 to C24) esters thereof such as (meth)acrylic acid, maleic anhydrides or maleic acid, maleic acid monoalkyl esters, fumaric acid, fumaric acid monoalkyl esters, crotonic acid, itaconic acid, itaconic acid monoalkyl esters, itaconic acid glycol monoethers, citraconic acid, citraconic acid monoalkyl esters, cinnamic acid, and the like.

(3) Sulfonic group-containing vinyl monomers, vinyl sulfuric acid monoesters, and salts of these compounds: alkene sulfonic acids having 2 to 14 carbon atoms such as vinyl sulfonic acid, (meth)allyl sulfonic acid, methylvinylsulfonic acid, and styrenesulfonic acid; styrenesulfonic acid derivatives having an alkyl (C2 to C24) group such as α-methylstyrene sulfonic acid; sulfo(hydroxy)alkyl-(meth)acrylates or sulfo(hydroxyl)alkyl-(meth)acrylamides such as sulfopropyl(meth) acrylate, 2-hydroxy-3-(meth)acryloxypropylsulfonic acid, 2-(meth)acryloylamino-2,2-dimethylethane sulfonic acid, 2-(meth)acryloyloxyethanesulfonic acid, 3-(meth)acryloyloxy-2-hydroxypropane sulfonic acid, 2-(meth)acrylamide-2-methylpropanesulfonic acid, and 3-(meth)acrylamide-2-hydroxypropanesulfonic acid; alkyl (C3 to C18) allylsulfosuccinic acid; sulfuric acid esters of poly (n=2 to 30) oxyalkylene (ethylene, propylene, and butylene; oxyalkylenes may be contained alone, randomly, or in blocks) mono (meth)acrylate such as poly (n=5 to 15) oxypropylenemonomethacrylate sulfuric acid esters; and polyoxyethylene polycyclicphenyl ether sulfuric acid esters.

(4) Phosphoric group-containing vinyl monomers and salts thereof: (meth)acryloyloxyalkylphosphoric acid monoesters such as 2-hydroxyethyl(meth)acryloylphosphate, and phenyl-2-acryloyloxyethylphosphate; (meth)acryloyloxyalkyl (C1 to C24) phosphonic acid such as 2-acryloyloxyethyl phosphonic acid; and salts thereof, and the like.

Note that examples of salts of compounds (2) to (4) include alkali metal salts such as sodium salts and potassium salts, alkalline earth metal salts such as calcium salts and magnesium salts, ammonium salts, amine salts, or quaternary ammonium salts.

(5) Hydroxyl group-containing vinyl monomers: hydroxylstyrene, N-methylol(meth)acrylamide, hydroxyethyl(meth) acrylate, hydroxypropyl(meth)acrylate, polyethyleneglycol mono(meth)acrylate, (meth)allyl alcohol, crotyl alcohol, isocrotyl alcohol, 1-buten-3-ol, 2-buten-1-ol, 2-buten-1,4-diol, propargyl alcohol, 2-hydroxyethyl propenyl ether, allyl ethers of saccharose, and the like.

(6) Nitrogen-Containing Vinyl Monomers:

Amino group-containing vinyl monomers: aminoethyl (meth)acrylate, dimethylaminoethyl(meth)acrylate, diethylaminoethyl(meth)acrylate, t-butylaminoethyl(meth)acrylate, N-aminoethyl(meth)acrylamide, (meth)allyl amine, morpholinoethyl(meth)acrylate, 4-vinyl pyridine, 2-vinyl pyridine, crotyl amine, N,N-dimethylamino styrene, methyl-α-acetoamino acrylate, vinylimidazole, N-vinyl pyrrole, N-vinyl thiopyrrolidone, N-arylphenylenediamines, aminocarbazole, aminothiazole, aminoindole, aminopyrrole, aminoimidazole, aminomercaptothiazole, and the like, and salts thereof.

Amide group-containing vinyl monomers: (meth)acrylamide, N-methyl(meth)acrylamide, N-butyl acrylamide, diacetone acrylamide, N-methylol(meth)acrylamide, N,N-methylene-bis(meth)acrylamide, cinnamic acid amide, N,N-dimethyl acrylamide, N,N-dibenzyl acrylamide, methacryl formamide, N-methyl-N-vinyl acetoamide, and N-vinyl pyrrolidone. Nitrile group-containing vinyl monomers: (meth) acrylonitrile, cyanostyrene, cyanoacrylate, and the like.

Quaternary ammonium cation group-containing vinyl monomers: quaternary ammonium salts prepared by quaternarization of tertiary amino group-containing vinyl monomers such as dimethylaminoethyl(meth)acrylate, diethylaminoethyl(meth)acrylate, dimethylaminoethyl(meth) acrylamide, diethylaminoethyl(meth)acrylamide, and diallyl amine, using quaternating agents such as methyl chloride, dimethyl sulfuric acid, benzyl chloride, and dimethyl carbonate.

Nitro group-containing vinyl monomers: nitrostyrene, and the like.

(7) Epoxy group-containing vinyl monomers: glycidyl(meth) acrylate, tetrahydrofurfuryl(meth)acrylate, p-vinylphenylphenyloxide, and the like.

(8) Vinyl Esters, Vinyl (Thio)Ethers, Vinyl Ketones, and Vinyl Sulfones:

Vinyl esters such as vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinylmethoxy acetate, vinyl benzoate, ethyl-α-ethoxy acrylate, alkyl(C1-C50)(meth)acrylates (e.g., methyl(meth) acrylate, ethyl(meth)acrylate, propyl(meth)acrylate, butyl (meth)acrylate, 2-ethylhexyl(meth)acrylate, dodecyl(meth)

acrylate, hexadecyl(meth)acrylate, heptadecyl(meth) acrylate, and eicosyl(meth)acrylate), dialkyl(each alkyl group has 2 to 8 carbon atoms and may be a straight chain, a branched chain, or an alicyclic structure) fumarates, dialkyl (each alkyl group has 2 to 8 carbon atoms and may be a straight chain, a branched chain, or an alicyclic structure) maleates, poly(meth)allyloxy alkanes (e.g., diallyloxy ethane, triallyloxy ethane, tetraallyloxy ethane, tetraallyloxy propane, tetraallyloxy butane, tetramethallyloxy ethane), vinyl monomers having a polyalkylene glycol chain (e.g., polyethylene glycol (molecular weight: 300) mono(meth) acrylate, polypropylene glycol (molecular weight: 500) monoacrylate, (meth)acrylic acid methanol ethylene oxide 10 mol adduct esters, (meth)acrylic acid lauryl alcohol ethylene oxide 30 mol adduct esters), and poly(meth)acrylates (e.g., poly(meth)acrylates of polyhydric alcohols, such as ethylene glycol di(meth)acrylate, propylene glycol di(meth)acrylate, neopentyl glycol di(meth)acrylate, trimethylolpropane tri (meth)acrylate, and polyethylene glycol di(meth)acrylate); and the like.

Vinyl (thio) ethers such as vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyran, 2-butoxy-2'-vinyloxydiethyl ether, vinyl-2-ethylmercaptoethyl ether, acetoxystyrene, and phenoxystyrene.

Vinyl ketones such as vinyl methyl ketone, vinyl ethyl ketone, and vinyl phenyl ketone.

Vinyl sulfones such as divinyl sulfide, p-vinyl diphenyl sulfide, vinyl ethyl sulfide, vinyl ethyl sulfone, divinyl sulfone, and divinyl sulfoxide.

(9) Other vinyl monomers: isocyanatoethyl(meth)acrylate, m-isopropenyl-α,α-dimethylbenzyl isocyanate, and the like.

(10) Fluorine-containing vinyl monomers: 4-fluorostyrene, 2,3,5,6-tetrafluorostyrene, pentafluorophenyl(meth)acrylate, pentafluorobenzyl(meth)acrylate, (meth)acrylate, perfluorocyclohexylmethyl(meth)acrylate, 2,2,2-trifluoroethyl(meth) acrylate, 2,2,3,3-tetrafluoropropyl(meth)acrylate, 1H,1H, 4H-hexafluorobutyl(meth)acrylate, 1H,1H,5H-octafluoropentyl(meth)acrylate, 1H,1H,7H-dodecafluoroheptyl(meth)acrylate, perfluorooctyl(meth) acrylate, 2-perfluorooctylethyl(meth)acrylate, heptadecafluorodecyl(meth)acrylate, trihydroperfluoroundecyl(meth)acrylate, perfluoronorbornylmethyl(meth)acrylate, 1H-perfluoroisobornyl(meth)acrylate, 2-(N-butyl perfluorooctane sulfonamide)ethyl(meth)acrylate, 2-(N-ethyl perfluorooctane sulfonamide)ethyl(meth)acrylate, and corresponding α-fluoroacrylates to the above (meth)acrylates; bis-hexafluoroisopropyl itaconate, bis-hexafluoroisopropyl maleate, bis-perfluorooctyl itaconate, bis-perfluorooctyl maleate, bis-trifluoroethyl itaconate, and bis-trifluoroethyl maleate; and vinyl heptafluorobutyrate, vinyl perfluoroheptanoate, vinyl perfluorononanoate, vinyl perfluorooctanoate, and the like.

Among the ester monomers mentioned above, the monomer expressed by General Formula (1) is preferable. Examples of such monomer include: methoxydiethylene glycol acrylate, methoxytriethylene glycol acrylate, methoxytetraethylene glycol acrylate, methoxypentaethylene glycol acrylate, methoxyhexaethylene glycol acrylate, methoxyheptaethylene glycol acrylate, methoxyoctaethylene glycol acrylate, methoxynonaethylene glycol acrylate, methoxydiethylene glycol methacrylate, methoxytriethylene glycol methacrylate, methoxytetraethylene glycol methacrylate, methoxypentaethylene glycol methacrylate, methoxyhexaethylene glycol methacrylate, methoxyheptaethylene glycol methacrylate, methoxyoctaethylene glycol methacrylate, methoxynonaethylene glycol methacrylate, phenoxydiethylene glycol acrylate, phenoxytriethylene glycol acrylate, phenoxytetraethylene glycol acrylate, phenoxypentaethylene glycol acrylate, phenoxyhexaethylene glycol acrylate, phenoxyheptaethylene glycol acrylate, phenoxyoctaethylene glycol acrylate, phenoxynonaethylene glycol acrylate, phenoxydiethylene glycol methacrylate, phenoxytriethylene glycol methacrylate, phenoxytetraethylene glycol methacrylate, phenoxypentaethylene glycol methacrylate, phenoxyhexaethylene glycol methacrylate, phenoxyheptaethylene glycol methacrylate, phenoxyoctaethylene glycol methacrylate, and phenoxynonaethylene glycol methacrylate.

Among vinyl copolymers using the above vinyl monomers, preferably copolymers of styrene and an acrylic monomer, more preferably copolymers of styrene and an ester monomer are used for the shell material of the present invention. Particularly preferably, the amounts of styrene and the ester monomer for copolymerization are preferably, respectively, 85% by mass to 65% by mass and 15% by mass to 35% by mass, particularly preferably, respectively, 80% by mass to 70% by mass and 20% by mass to 30% by mass.

When the amount of the ester monomer is 35% by mass or less, the glass transition temperature (Tg) of the shell material can be made higher than the glass transition temperature (Tg) of the core, which results in production of a shell layer which effectively serves as a protective layer for the core. When the amount of the ester monomer is 15% by mass or more, the ester monomer can effectively serve as a stickifier to the core.

<Fine Vinyl Copolymer Resin Particle>

The vinyl copolymer resin for use during production of the toner is more preferably a fine vinyl copolymer resin particle which is dispersed in a water-based medium. The fine vinyl copolymer resin particle dispersion may be readily prepared by general emulsification polymerization, and the like. In addition, the fine vinyl copolymer resin particle must adhere to the surface of the core particle in the presence of an organic solvent. When the fine vinyl copolymer resin particle is excessively stabilized as a fine particle dispersion in a medium containing an organic solvent, it becomes difficult for the fine vinyl copolymer resin particle to be deposited on and adhere to the core particle, and a portion of the fine vinyl copolymer resin particle may remain as a fine particle unbound to the core particle.

<Production Method of Toner>

Hereinafter, examples of a method for producing the toner will be described, however, the method for producing the toner is not limited to these examples. The method for producing the toner includes, at least, forming core particles by dissolving or dispersing a resin having at least a polyester backbone and a releasing agent in an organic solvent and, then, by suspending the resultant solution or dispersion in a water-based medium, coating the resultant core particles with a fine particle dispersion containing a fine vinyl copolymer resin to form a shell layer, and removing the organic solvent from the resultant toner.

More specifically the production method is as follows:

—Granulation of Core Particle—

(Organic Solvent)

Organic solvents for use in granulation are preferably organic solvents which have boiling points of less than 100° C., and are volatile, from the viewpoint of readiness in their removal from the toner carried out at the subsequent step.

Organic solvents for use in granulation is not particularly limited and may be appropriately selected depending on the intended purpose; examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination. Among these organic solvents, particularly preferably, ester solvents such as methyl acetate and ethyl acetate, aromatic solvents such as toluene and xylene, and halogenated hydrocarbons such as methylene chloride, 1,2-dichloroethane, chloroform, carbon tetrachloride are used in the present invention.

The polyester resin and the colorant may be mixed before dissolving or dispersing, or they may typically be dissolved or dispersed individually in the same organic solvent or in different organic solvents from each other. When the polyester resin and the colorant are dissolved or dispersed individually, preferably the same organic solvent is used for them, from the view point of readiness in treatment performed on the resultant solution or dispersion to remove the organic solvent. Note that a solvent (as a single compound or a mixture) dissolving the polyester resin best will not dissolve appreciable amount of the releasing agent that is preferably used in the present invention, due to difference in solubility thereof —Dissolution or Dispersion of Hybrid Resin and Polyester Resin—

Preferably, the concentration of resins in the solution or the dispersion of the hybrid resin and the polyester resin is 40% by mass to 80% by mass. When the concentration of resins is extremely high, it becomes difficult to dissolve or disperse resins, and to handle the solution or the dispersion of resins because the viscosity thereof becomes high. Meanwhile, when the resin concentration is extremely low, the amount of the fine particle that is produced is reduced and the amount of a solvent to be removed is increased. When a polyester resin modified with an isocyanate group at its termini is mixed with a polyester resin, the modified polyester resin and the polyester resin may be mixed in the same solution or dispersion, or may be prepared in different solutions or dispersions prior to mixing. Considering different solubility and viscosity shown by each of the modified polyester resin and the polyester resin, preferably the modified polyester resin and the polyester resin are prepared in different solutions or dispersions prior to mixing.

—Water-Based Medium—

The water-based medium may be water alone or a combination of water and a solvent miscible with water. The solvent miscible with water is not particularly limited and may be appropriately selected depending on the intended purpose; examples thereof include alcohols such as methanol, isopropanol, and ethylene glycol, dimethylformamide, tetrahydrofuran, cellosolves such as methyl cellosolves, and lower ketones such as acetone and methylethylketone.

The amount of a water-based medium relative to 100 parts by mass of the fine resin particle is preferably 50 parts by mass to 2,000 parts by mass, and more preferably 100 parts by mass to 1,000 parts by mass.

—Inorganic Dispersant and Fine Organic Resin Particle—

Preferably an inorganic dispersant or a fine organic resin particle is predispersed in a water-based medium before dispersing a solution or a dispersion of the polyester resin and the releasing agent in the water-based medium, because thereby the polyester resin in the water-based medium may have a sharp particle size distribution and the resultant dispersion becomes stable.

Examples of the inorganic dispersant include tricalcium phosphate, calcium carbonate, titanium oxide, colloidal silica, and hydroxyapatite. The resin used in forming the fine organic resin particle may be any resin, as long as it can form a water-based dispersion thereof, and may be a thermoplastic resin or a thermosetting resin; examples thereof include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These may be used alone or in combination. Among them, particularly preferably vinyl resins, polyurethane resins, epoxy resins, and polyester resins may be used, alone or in combination, because the water-based dispersion of a fine spherical resin particle may be readily prepared from these resins and resin combinations.

—Surfactant—

A surfactant and the like may be used, as required, for manufacturing the fine resin particle. The surfactant is not particularly limited and may be appropriately selected depending on the intended purpose; examples thereof include anionic surfactants such as alkyl benzene sulfonates, α-olefin sulfonates and phosphate esters; cationic surfactants such as amine salts including alkylamine salts, aminoalcohol fatty acid derivatives, polyamine fatty acid derivatives, and imidazolines and quaternary ammonium salts including alkyltrimethyl ammonium salts, dialkyldimethyl ammonium salts, alkyldimethylbenzyl ammonium salts, pyridinium salts, alkylisoquinolinium salts, and benzethonium chlorides; nonionic surfactants such as fatty acid amide derivatives and polyhydric alcohol derivatives; ampholytic surfactants such as alanine, dodecyl diaminoethyl glycine, dioctylaminoethyl glycine, and N-alkyl-N,N-dimethyl ammonium betaine.

In addition, when a surfactant having a fluoroalkyl group is employed, it may be effective even in a very small amount in manufacturing the fine resin particle. Examples of anionic surfactants having a fluoroalkyl group that are preferably used include fluoroalkyl carboxylic acids having 2 to 10 carbon atoms or metal salts thereof, disodium perfluorooctanesulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acids or metal salts thereof, perfluoroalkyl carboxylic acids (C7 to C13) or metal salts thereof, perfluoroalkyl sulfonic acids (C4 to C12) or metal salts thereof, perfluorooctane sulfonic acid diethanolamide, N-propyl-N-(2-hydroxyethyl) perfluorooctane sulfonamide, perfluoroalkyl (C6 to C10) sulfonamide propyltrimethyl ammonium salts, perfluoroalkyl (C6 to C10)-N-ethylsulfonyl glycine salts, and monoperfluoroalkyl (C6 to C16) ethyl phosphate ester. Examples of the cation surfactants include aliphatic primary, secondary and tertiary amine acids having the fluoroalkyl group, aliphatic quaternary ammonium salts such as perfluoroalkyl (C6 to C10) sulfonamide propyltrimethyl ammonium salts, benzalkonium salts, benzethonium chloride, pyridinium salts, and imidazolium salts.

—Protective Colloid—

Macromolecule protective colloid may be used to stabilize dispersed liquid droplets when the fine resin particle is manufactured. For protective colloid the following may be used: homopolymers or copolymers of monomers such as acids, e.g., acrylic acid, methacrylic acid, α-cyanoacrylic acid, α-cyanomethacrylic acid, itaconic acid, crotonic acid, fumaric acid and maleic acid (including anhydride); (meth) acrylic monomers containing a hydroxyl group, e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide and N-methylol methacrylamide;

vinyl alcohols and ethers thereof; e.g., vinyl methyl ether, vinyl ethyl ether, vinyl propyl ether; esters of compounds containing vinyl alcohol and a carboxyl group, e.g., vinyl acetate, vinyl propionate and vinyl butyrate; acrylamide, methacrylamide, diacetone acrylamide and methylol compounds thereof; acid chlorides, e.g., acrylic acid chloride and methacrylic acid chloride; compounds containing a nitrogen atom or a heterocyclic ring, e.g., vinyl pyridine, vinyl pyrrolidone, vinyl imidazole and ethyleneimine; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylenenonylphenyl ether, polyoxyethylenelaurylphenyl ether, polyoxyethylenestearylphenyl ester and polyoxyethylenenonylphenyl ester; and celluloses, e.g., methyl cellulose, hydroxyethyl cellulose and hydroxypropyl cellulose. When a compound soluble in acid or alkali, e.g., calcium phosphate salt is used as a dispersion stabilizer, the calcium phosphate salt is removed from the fine particles by dissolving the salt in an acid, e.g., hydrochloride and then by washing the salts with water. Moreover, it may be removed by enzyme-aided decomposition. When a dispersant is used, it may remain untreated on the surface of toner particles, but it is preferable to remove it by washing, from the view point of toner electrostatic chargeability.

—Method for Dispersion—

The dispersion method is not particularly limited, may be appropriately selected depending on the intended purpose, and may be carried out by a known machine, e.g., low-speed shearing machine, high-speed shearing machine, fractioning machine, high-pressure jet machine or ultrasonic machine. When the high-speed shearing dispersing machine is employed, its revolution frequency is not particularly limited, may be appropriately selected depending on the intended purpose, and is preferably 1,000 rpm to 30,000 rpm, and more preferably 5,000 rpm to 20,000 rpm. The temperature during dispersion (carried out under pressure) is preferably 0° C. to 150° C., and more preferably 20° C. to 80° C.

—Desolvation—

An organic solvent can be removed from the resultant emulsified dispersion by a known method. For example, evaporation in which the dispersion is gradually heated under normal pressure or a vacuum may be adopted to completely remove an organic solvent from liquid droplets.

—Propagation or/and Crosslinking Reactions—

When a polyester resin modified with an isocyanate group at termini and an amine reactive with the resin are reacted to produce a polyester resin modified with a urethane or/and urea group in the toner in a water-based medium, the amine may be incorporated into an oil phase before a toner composition containing the oil phase is dispersed in the water-based medium, or the amine may be directly incorporated into the water-based medium. The time period for the reaction may be selected in accordance with the structure of isocyanate groups in the polyester prepolymer and isocyanate groups' reactivity with amines and is preferably one min to 40 hr, more preferably 1 hr to 24 hr. The temperature for the reaction is preferably 0° C. to 150° C., and more preferably 20° C. to 98° C.

[Shell Forming Process]

When the resultant core particle dispersion liquid is stirred, the core particle dispersion liquid may be kept in a state where disperse core particle liquid droplets are stabilized in the dispersion liquid. Then, a dispersion liquid of the above-mentioned fine vinyl copolymer resin particle is added to the core particle dispersion liquid in the above state for allowing the fine vinyl copolymer resin particle to adhere onto the core particle. The duration during which the dispersion liquid of the fine vinyl copolymer resin particle is added to the core particle dispersion liquid for adhesion of the fine vinyl copolymer resin particle to the core particle is preferably 30 sec or longer. When the duration during which the dispersion liquid of the fine vinyl copolymer resin particle is added to the core particle dispersion liquid is shorter than 30 sec, an aggregate of particles may be produced or the surface of the core particle may be unevenly coated with the fine vinyl copolymer resin particle because of a rapid change of the dispersion system. Meanwhile, when the duration is longer than 60 min, efficiency of the production may be impaired.

The dispersion liquid of the fine vinyl copolymer resin particle may be diluted or condensed for appropriately adjusting the concentration thereof prior to addition thereof into the core particle dispersion liquid. The concentration of the dispersion liquid of the fine vinyl copolymer resin particle is preferably 5% by mass to 30% by mass, and more preferably 8% by mass to 20% by mass. When the concentration of the dispersion liquid of the fine vinyl copolymer resin particle is lower than 5% by mass, the core particle may be insufficiently coated with the fine resin particle, because the concentration of an organic solvent in the resultant mixture of dispersion liquids may be greatly altered due to the incorporation of the dispersion liquid of the fine vinyl copolymer resin particle. When the concentration of the dispersion liquid of the fine vinyl copolymer resin particle is higher than 30% by mass, fine vinyl resin particles tend to concentrate in more localized areas in the core particle dispersion liquid mixed with the dispersion liquid of the fine vinyl copolymer resin, which may result in uneven coatings on the core particle with the fine vinyl resin particle.

According to the method for producing the toner as mentioned above, it is considered that fine vinyl copolymer resin particles may adhere to core particles with adequate adherence because when fine vinyl copolymer resin particles adhere to liquid droplets of core particles the surface of a core particle may freely change in shape so as to provide sufficient contact areas with interfaces of fine vinyl copolymer resin particles and that fine vinyl copolymer resin particles may swell or be dissolved with an organic solvent so as to make easy the adhesion of fine vinyl copolymer resin particles with resins contained in the core particle. Therefore, it is necessary in this situation that a sufficient amount of the organic solvent be exist in the system. Specifically, the amount of the fine vinyl copolymer resin particle for incorporation into the core particle dispersion liquid in the above-mentioned state is preferably 50 parts by mass to 150 parts by mass, and more preferably 70 parts by mass to 125 parts by mass, relative to 100 parts by mass of the solid contents (including a resin, a colorant, and as required a releasing agent or a charge control agent). When the amount of the fine vinyl copolymer resin particle for incorporation into the core particle dispersion liquid is more than 150 parts by mass, the amount of a resin particle having a colorant that can be yielded in one production process may be reduced, resulting in impairment of the efficiency for production, and stable production of the resin particle having a colorant may become difficult to achieve because the dispersion stability of the core particle may be impaired by the large amount of the organic solvent incorporated with the fine vinyl copolymer resin particle.

The temperature at which fine vinyl copolymer resin particles are allowed to adhere to core particles is preferably 10° C. to 60° C., more preferably 20° C. to 45° C. When the temperature at which fine vinyl copolymer resin particles are allowed to adhere to core particles is higher than 60° C., the amount of energy required for production may be increased, leading to increase in a load applied to the environment of the production process, and the state of dispersion of core particle liquid droplets, surfaces of which are coated with fine vinyl copolymer resin particles having a low acid value, becomes unstable, increasing the risk of production of coarse particles. On the other hand, when the temperature is lower than 10° C., the viscosity of the dispersion becomes extremely high, and the adherence of the fine resin particle to the core particle may become inadequate for the adhesion of the fine resin particle to the core particle.

[Cleaning and Drying]

Known procedures are used for cleaning and drying toner particles dispersed in a water-based medium. For example, toner particles may be produced by a series of steps, that is subjecting the dispersion to solid/liquid separation by means of a centrifugal separator, a filter press or the like, redispersing the resultant toner cake in ion-exchanged water kept at normal temperature to around 40° C., adjusting the pH with an acid or alkali as required, and, again, subjecting the resultant dispersion to solid/liquid separation. The series of steps are repeated several times to remove impurities and surfactants, and are then a drying step is carried out using instruments such as an air dryer, a circulation dryer, a vacuum drier, a vibrational/fluidization drier or the like. A fine toner particle component may be removed by a centrifugal separator, or the resultant toner particles are classified using a known classifier, as required, after drying so that the resultant toner particles have a desired particle size distribution.

[Treatment with External Additive]

Other types of particles, e.g., fine charge control particles, fine fluidizing particles, or the like, may be incorporated into the resultant toner powder after drying and may be fixed or fused on surfaces of the toner powder particles by application of mechanical impact force, thereby detachment of these particles from the resultant composite particles may be prevented. Specifically, prevention of the detachment of these particles from the resultant composite particles may be achieved by a method of applying mechanical impact force to the composite powder using blades rotating at high speed, or a method of throwing the composite powder into high-speed air flow, accelerating composite particles against one another or against a suitable impinging plate. Examples of equipment used for such purposes include ANGMILL (Hosokawa Micron, Ltd.), I-MILL (Nippon Pneumatic MFG. Co., Ltd.) which is remodeled such that crushing air pressure may be decreased, HYBRIDIZATION SYSTEM (Nara Machinery Co., Ltd.), CRIPTRON SYSTEM (Kawasaki Heavy Industries, Ltd.), automatic mortar or the like.

<Image Forming Method, Image Forming Apparatus, and Process Cartridge>

[Image Forming Apparatus and Process Cartridge]

The image forming apparatus according to the present invention is an image forming apparatus which forms images using the toner of the present invention. Note that the toner of the present invention may be used in both one-component developer and two-component developer, however, is preferably used for one-component developer. The image forming apparatus of the present invention is preferably equipped with an endless intermediate transfer unit. Furthermore, the image forming apparatus of the present invention is preferably equipped with a photoconductor, and a cleaning unit configured to clean residual toner remaining on the photoconductor and/or the intermediate transfer unit. The cleaning unit may or may not have a cleaning blade in the image forming apparatus. Furthermore the image forming apparatus of the present invention is preferably equipped with a fixing unit using a roller or a belt which contained a heating device. In addition, the fixing unit of the image forming apparatus of the present invention preferably fix images without using oil applied on a fixing member. The image forming apparatus of the present invention is preferably, further, equipped with additional units, which has been appropriately selected as required, such as a charge eliminating unit, a recycling unit, and a controlling unit.

The image forming apparatus of the present invention may contain a process cartridge detachably mounted on the main body of the image forming apparatus, which process cartridge contains elements such as a photoconductor, a developing unit, and a cleaning unit. The process cartridge of the image forming apparatus of the present invention is mounted on the main body of the image forming apparatus as a single detachable unit, can be detached using a guide unit of the main body, such as rails, configured to detach the process cartridge, and is equipped with, in addition to a photoconductor, at least one of a charging unit, an exposing unit, a developing unit, a transfer unit, a separating unit, and a cleaning unit.

Figure 2:
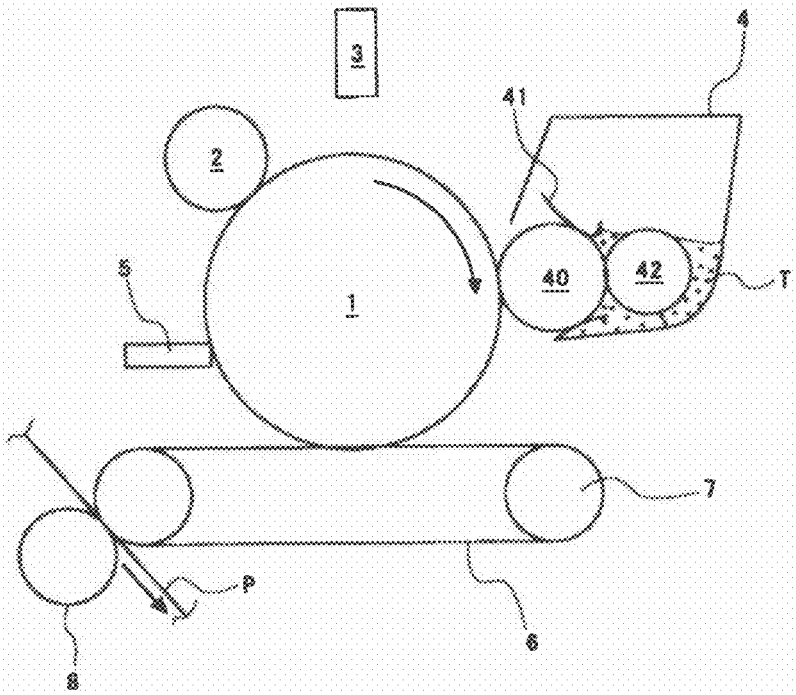
FIG. 2 is an explanatory view of a principal part of one embodiment of an image forming apparatus in which a toner of the present invention is used.

FIG. 2 illustrates an example of the image forming apparatus of the present invention. The image forming apparatus is equipped with a latent image bearing member 1, which is contained in an enclosure of the main body (not shown) and is driven to rotate in a clockwise direction in FIG. 2, and, around the latent image bearing member 1, with a charging unit 2, an exposing unit 3, a developing unit 4 containing the electrostatic image developing toner T of the present invention, a cleaning member 5, an intermediate transfer member 6, a supporting roller 7, a transfer roller 8, a charge eliminating unit (not shown), and the like.

The image forming apparatus is equipped with a paper supply cassette (not shown) configured to contain sheets of recording paper P serving as a recording medium, wherein sheets of recording paper P in the paper supply cassette are fed into a slit between a transfer roller 8 as a transfer unit and an intermediate transfer member 6 one by one by means of a paper supply roller (not shown), with correct timing which is adjusted by a pair of registration roller (not shown).

In this image forming apparatus, the latent image bearing member 1 is driven to rotate in a clockwise direction, as shown in FIG. 2, and uniformly charged with the charging unit 2, an electrostatic latent image is formed on the latent image bearing member 1 with an exposing unit 3 configured to irradiate a laser beam which is modulated so as to convey image data, and then the electrostatic image is developed on the latent image bearing member 1 with a toner using a developing unit 4. Subsequently, the resultant toner image is transferred onto an intermediate transfer member 6 by applying a transfer bias from the latent image bearing member 1, on which a toner image has been formed with a developing device 4, to the intermediate transfer member 6, a sheet of recording paper P is fed into the slit between the intermediate transfer member 6 and a transfer roller 8, and thereby the transferred toner image is transferred onto the sheet of recording paper P. Further, the sheet of recording paper P on which the toner image has been transferred is fed into a fixing unit (not shown).

The fixing unit is equipped with a fixing roller which is heated with a built-in heater at predetermined fixing temperature, and with a pressure roller which is pressed to the fixing roller under predetermined pressure, wherein the sheet of recording paper conveyed from the transfer roller 8 is heated, pressed, and ejected to a paper ejection tray (not shown) after the toner image on the sheet of recording paper has been fixed.

Meanwhile, in the image forming apparatus, the latent image bearing member 1 from which the toner image has been transferred to the sheet of recording paper using the transfer roller 8 is further rotated, a residual toner remaining on a surface of the latent image bearing member 1 is scraped off and removed with a cleaning member 5, and the charge on the latent image bearing member 1 is eliminated with a charge eliminating unit (not shown). The latent image bearing member 1 from which the remaining charge has been eliminated is uniformly charged with a charging unit 2, and then enters the next cycle of steps for image forming, as mentioned above.

Hereinafter, each member which is preferably used in the image forming apparatus of the present invention will be described in more detail.

The material, shape, structure, size, etc., of the latent image bearing member 1 are not specifically limited and can be appropriately selected from those known in the art. The latent image bearing member 1 is preferably drum-shaped or a belt is preferably drum-shaped or a belt. The material of the latent image bearing member may be, for example, an inorganic latent image bearing member made of amorphous silicon, selenium, or the like, or an organic latent image bearing member made of polysilane, phthalopolymethine, or the like. Among these, amorphous silicon or an organic latent image bearing member is preferred in terms of achieving long life.

The latent electrostatic image formation is carried out, for example, by imagewise exposure of a surface of the latent electrostatic image bearing member 1 right after uniformly charging the surface of the latent electrostatic image bearing member 1. This may be performed by means of the latent electrostatic image forming unit. The latent electrostatic image forming unit includes at least a charging unit 2 configured to uniformly charge the surface of the latent electrostatic image bearing member 1, and an exposure unit 3 configured to imagewisely expose the surface of the latent electrostatic image bearing member 1.

The charging step can be performed, for example, by applying voltage on the surface of the latent image bearing member 1 using a charging device 2.

The charging device 2 is not particularly limited, can be selected suitably depending on the purpose, and includes, for example, known contact charging device equipped with conductive or semi-conductive roller, brush, film or rubber blade and non-contact charging device using corona discharge such as corotron and scorotron.

The shape of the charging unit 2 may be a magnetic brush and a fur brush in addition to a roller and may be selected according to the specification or form of the electrophotographic device. When a magnetic brush is employed, the magnetic brush includes at least a charging member containing various ferrite particles such as Zn—Cu ferrite, a non-magnetic electroconductive sleeve configured to support the charging member, and a magnetic roll which is enclosed in the sleeve. When a fur brush is used, the fur brush includes at least fur made electroconductive by depositing carbon, copper sulfide, a metal or a metal oxide, and a metal object or a cored bar which is made electroconductive, wherein the fur is wound around or pasted onto the metal object or the cored bar.

The charging unit 2 is not limited to such a contact type charger as mentioned above, however, preferably the contact type charger is used in the image forming apparatus because the amount of ozone produced by the image forming apparatus may be reduced.

The exposure can be performed, for example, by exposing the surface of the latent electrostatic image bearing member imagewise by means of the exposing unit 3.

The exposing unit 3 is not particularly limited so far as it can expose imagewise the surface of the latent electrostatic image bearing member 1 charged with the charging unit 2, can be selected suitably depending on the purpose, and includes, for example, copy optical systems, rod lens array systems, laser optical systems and liquid crystal shutter optical systems.

The developing step can be performed, for example, by developing the latent electrostatic images using the toner of the present invention by means of a developing device 4.

The developing device 4 is not particularly limited so far as it can develop using the toner of the present invention, can be selected suitably from the known ones, and includes, for example, preferably the developing units having at least a developing device which houses the toner of the present invention and can provide the toner to the latent electrostatic images in a contact or non-contact manner.

Preferably the developing unit 4 includes a developing roller 40 configured to bear the toner on the surface thereof, rotate in contact with the latent image bearing member 1, and develop an electrostatic latent image formed on the latent image bearing member 1 by supplying a toner, and a thin membrane forming member 41 which is in contact with the developing roller 40 and thins the toner layer on the developing roller 40.

The developing roller 40 for preferable use is one of a metal roller and an elastic roller. The metal roller is not particularly limited and may be appropriately selected depending on the intended purpose; examples thereof include an aluminum roller. A developing roller 40 having the surface with any size of friction coefficient may be relatively easily manufactured by subjecting the metal roller to blast treatment. Specifically, a developing roller which has a roughened surface and may bear an appropriate amount of toner thereon may be produced from an aluminum roller by subjecting the aluminum roller to glass beads blast treatment.

A roller which is covered by an elastic rubber layer and further by a surface coat layer formed of a material that is ready to form the opposite charge to the charge of the toner may be used for the elastic roller, wherein the surface coat layer is the outer most layer. The hardness of the elastic rubber layer is 60 degrees or lower as quantified according to JIS-A, for preventing degradation of the toner due to the pressure concentrated on the contact area of the elastic roller with the thin layer forming member 41. The surface roughness Ra of the elastic roller is made to fall within the range between 0.3 μm and 2.0 μm such that a required amount of the toner may be borne on the surface thereof. The resistance of the elastic rubber layer is controlled within the range between $10^3\Omega$ and $10^{10}\Omega$ because it is necessary to apply a bias between the latent image bearing member 1 and the developing roller 40 for developing an image. The developing roller 40 rotates in a clockwise direction and thereby a toner on the surface thereof is conveyed to an area in contact with a thin-layer forming member 41 and to an area counter to the latent image bearing member 1.

The thin-layer forming member 41 is disposed in a position lower than the contact area of a supply roller 42 and the developing roller 40. The thin-layer forming member 41 is a metal blade spring made from material such as stainless (SUS) and phosphor bronze, wherein a free end thereof is pressed against the surface of the developing roller 40 with pressing force of 10 N/m to 40 N/m, and thereby the toner layer is thinned under the pressing force and provided with electric charge by frictional electrification when it passes under the thin-layer forming member. Furthermore, a controlling bias is applied to the thin-layer forming member 41, wherein the controlling bias has the same charge polarity as the toner with respect to the developing bias and is used for controlling a bias by supplementing electricity to the frictional electrification.

The rubber elastic body constituting the surface of the developing roller 40 is not particularly limited and may be appropriately selected depending on the intended purpose; examples thereof include styrene-butadiene rubber, acrylonitrile-butadiene rubber, acrylic rubber, epichlorohydrin rubber, urethane rubber, silicone rubber, and a blend of two or more of the these rubbers. Among these rubbers, a rubber blend of epichlorohydrin rubber and acrylonitrile-butadiene rubber is particularly preferably used.

The developing roller 40 contains an electroconductive shaft, wherein the circumferential surface of the shaft is covered by an elastic rubber body. Material for the electroconductive shaft is a metal such as stainless (SUS).

The transferring can be performed by charging the latent image bearing member 1 using a transfer roller. The transfer roller is preferably an aspect of a transfer roller having a primary transfer unit configured to transfer toner images onto an intermediate transfer member 6 to form transferred images and having a secondary transfer unit (a transfer roller 8) configured to transfer the transferred images onto recording paper P. The transferring is performed using a dichromatic or more toner, preferably a full color toner for a toner, wherein the transferring further preferably include primary transferring by which a complex transfer image can be formed by transferring the toner image onto the intermediate transfer member 6, and secondary transferring by which the complex transfer image is transferred onto the recording paper P.

The intermediate transfer member 6 is not particularly limited, can be selected suitably from the known transfer members depending on the purpose, and includes, for example, favorably a transfer belt.

The transfer unit (the primary transfer unit and the secondary transfer unit) preferably contains at least a transfer device for peeling the toner images formed on the latent electrostatic image bearing member 1 and charging them on the side of the recording paper P. The transfer units may be provided as a single unit or as two or more units.

The transfer device includes corona transferring devices using corona discharge, transfer belts, transfer rollers, pressure transfer rollers and adhesive transferring devices.

The recording paper is commonly regular paper, is not particularly limited as far as it an unfixed image after development can be transferred, and can be appropriately selected. PET base for OHP can be used for the recording paper.

The fixing step is a step for fixing the transfer images transferred on the recording paper P using a fixing unit, and may be performed for each toner having a color to be transferred on the recording paper P or simultaneously after all colors are laminated.

The fixing unit is not particularly limited, can be selected suitably depending on the purpose, and known heating and pressing units are appropriate. The heating and pressing unit includes combinations of heating rollers and pressing rollers, combinations of heating rollers, pressing rollers, and endless belts.

The heating temperature of the heating and pressing unit is preferably 80° C. to 200° C.

Figure 3:
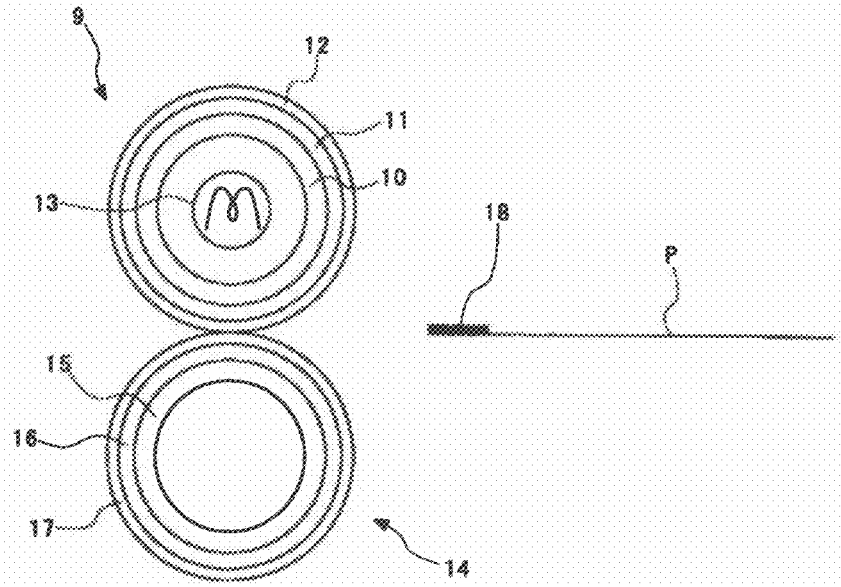
FIG. 3 is an explanatory view of a structure of a fixing unit used in an image forming apparatus in which a toner of the present invention is used.

The fixing device may be, as shown in FIG. 3, a fixing device which contains a soft roller containing a surface layer formed of a fluorinated material. In this device, the heating roller 9 includes at least an aluminum core drum 10, an elastic layer 11 made of silicone rubber and a PFA (Ethylene tetrafluoride-perfluoroalkyl vinyl ether copolymer) surface layer 12 disposed on the aluminum core drum 10, and a heater 13 disposed inside the aluminum core drum. Moreover, in the aforementioned device, the pressing roller 14 contains at least an aluminum core drum 15, an elastic layer 16 formed of silicone rubber and a PFA surface layer 17 disposed on the aluminum core drum 15. Note that a sheet of recording paper P on which an unfixed image 18 has been transferred is fed into the fixing device in the manner as shown in FIG. 3.

In addition, a known optical fixing device may be used with or in place of the fixing unit, depending on the intended purpose in the present invention.

The charge eliminating step is a step for charge elimination by applying a charge-eliminating bias to the latent electrostatic image bearing member, and is performed suitably by means of the charge eliminating unit. The charge eliminating unit is not particularly limited so far as it can apply a discharge bias to the latent electrostatic image bearing member, can be selected suitably from known charge eliminating devices, and includes, for example, suitably charge eliminating lamps and so forth.

The cleaning step is a step for removing the residual toner particles remaining on the latent electrostatic image bearing member, and can be performed suitably by the cleaning unit. The cleaning unit is not particularly limited so far as it can remove the residual toner particles remaining on the latent electrostatic image bearing member, can be selected suitably from known cleaners, and includes, for example, magnetic brush cleaners, electrostatic brush cleaners, magnetic roller cleaners, cleaning blades, brush cleaners, and web cleaners.

The recycling step is a step for recycling the toner particles removed in the cleaning step for use in the developing unit, and can be performed suitably by means of the recycling unit. The recycling unit is not particularly limited, and includes known conveying units and so forth.

The controlling step is a step for controlling each of the steps described above, can be performed suitably by means of the controlling unit. The controlling unit is not particularly limited so far as it can control the operations of each unit, can be selected suitably depending on the purpose, and includes, for example, such instruments as sequencers and computers.

According to the image forming apparatus, the image forming method, and the process cartridge of the present invention, a favorable image may be formed by using an electrostatic latent image developing toner which achieves excellent fixing ability and is free from cracking caused by stress produced during developmental process.

[Polychromatic Image Forming Apparatus]

Figure 4:
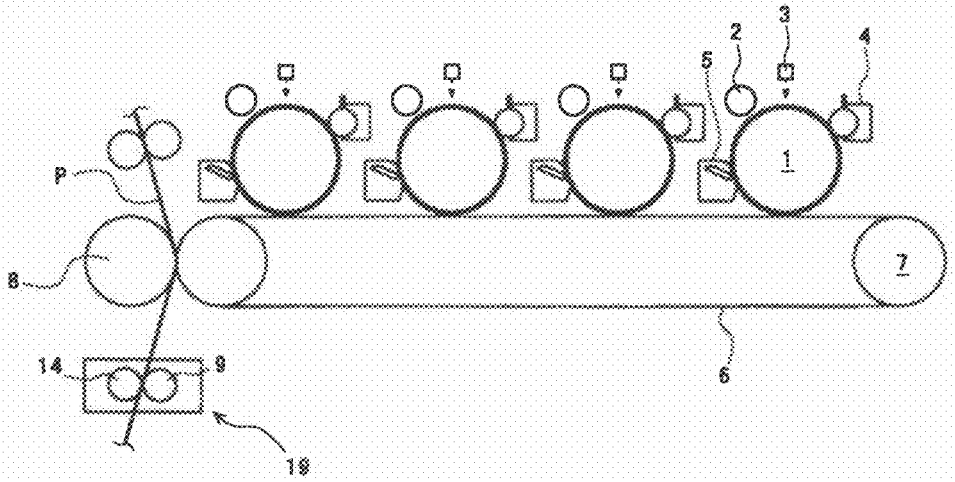
FIG. 4 is an explanatory view showing an example of an image forming apparatus in which a toner of the present invention is used.

FIG. 4 is a schematic view showing an example of a polychromatic image forming apparatus which uses the present invention. The polychromatic image forming apparatus shown in FIG. 4 is a tandem-type full-color image forming apparatus.

The image forming apparatus of FIG. 4 is equipped with latent image bearing members 1 which are contained in an enclosure (not shown) of the image forming apparatus body and are driven to rotate in a clockwise direction in FIG. 4, and equipped with, around each latent image bearing member 1, a charging unit 2, an exposing unit 3, a developing unit 4, an intermediate transfer member 6, a supporting roller 7, a transfer roller 8, and the like. Although not shown in FIG. 4, the image forming apparatus is equipped with a paper supply cassette which contains multiple sheets of recording paper, wherein sheets of recording paper P in the paper supply cassette is fed into a slit between the intermediate transfer member 6 and a transfer roller 8 one by one by means of a paper supply roller (not shown) with correct timing adjusted by a pair of registration rollers (not shown), and the image transferred on the fed-sheet of recording paper is fixed with a fixing unit 19.

In the image forming apparatus, each latent image bearing member 1 is driven to rotate in a clockwise direction in FIG.

4, uniformly charged with the charging unit 2, and then, exposed, with the exposing unit 3, to a laser beam which is modulated so as to convey image data, forming an electrostatic latent image on the latent image bearing member 1 which electrostatic latent image is developed with the developing device 4 with supply of a toner to the latent image bearing member. In the image forming apparatus, a toner image which has been formed on the latent image bearing member with a developing device 4 using supply of toner is transferred from the latent image bearing member 1 to the intermediate transfer member. A full-color toner image is formed by performing the above steps for each of four colors, i.e. cyan (C), magenta (M), yellow (Y), and black (K), with multiple latent image bearing members.

Figure 5:
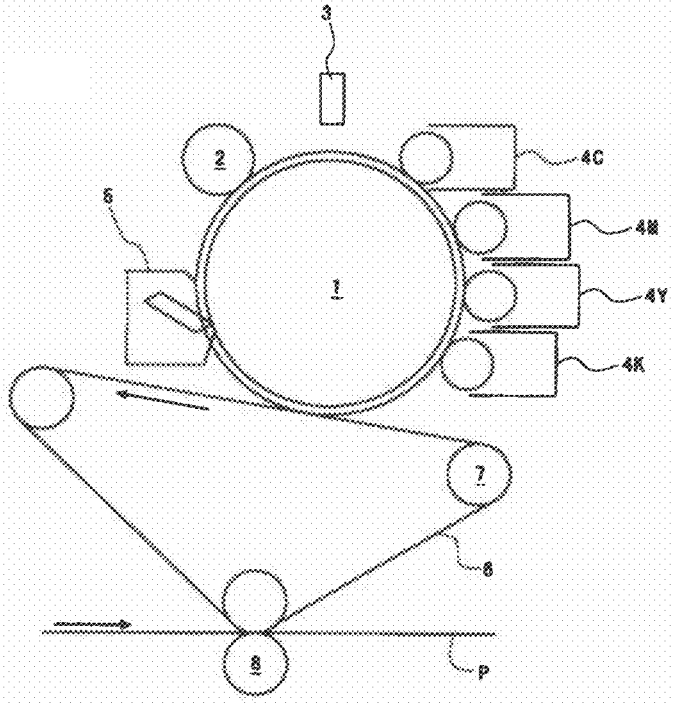
FIG. 5 is an explanatory view showing another example of an image forming apparatus in which a toner of the present invention is used.

FIG. 5 is a schematic view showing an example of a revolver-type full-color image forming apparatus. In this image forming apparatus, an image is developed successively using a plurality of color toners on a single latent image bearing member 1 by switching operations of developing devices. Then a color toner image present on an intermediate transfer member 6 is transferred to a sheet of recording paper P by a transfer roller 8. The sheet of recording paper P with the transferred toner image is fed into a fixing unit to fix the transferred toner image on the sheet.

Meanwhile, in the image forming apparatus, the latent image bearing member 1, from which the toner image has been transferred to a sheet of recording paper P via the intermediate transfer member 6, is further rotated and cleaned with a cleaning unit 5 by scraping off the residual toner remaining on the surface of the latent image bearing member 1 with a blade, and then the charge on the latent image bearing member 1 is eliminated with a charge eliminating unit. In the image forming apparatus, the latent image bearing member 1 from which charge has been eliminated with a charge eliminating unit is uniformly charged with a charging unit 2, and again the cycle of image forming as mentioned above is started. Note that the cleaning unit 5 is not limited to a cleaning unit using a blade for scraping off the residual toner on the latent image bearing member 1, but may be a cleaning unit using a fur brush for scraping off the residual toner on the latent image bearing member 1.

An excellent image may be produced with an image forming apparatus according to the present invention because the toner of the present invention is used for the developer in the image forming apparatus.

(Process Cartridge)

The process cartridge according to the present invention includes at least a latent electrostatic image bearing member for bearing latent electrostatic images and a developing unit for developing the latent electrostatic images born on the latent electrostatic image bearing member with the toner of the invention and forming visible images, and further includes other units suitably selected as required, such as a charging unit, a developing unit, a transfer unit, a cleaning unit, and a charge eliminating unit, wherein the process cartridge can be detachably mounted on the main body of the image forming apparatus.

The developing unit contains at least a developer container for containing the toner or the developer of the present invention and a developer bearing member for bearing and conveying the toner or the developer contained in the developer container, and may further contain a layer-thickness control member for controlling the thickness of toner layer born by the developer bearing member.

The process cartridge may be detachably mounted on image forming apparatuses, facsimiles, and printers of various electrophotographic methods, is preferably detachably mounted on the image forming apparatus according to the present invention described later.

Figure 6:
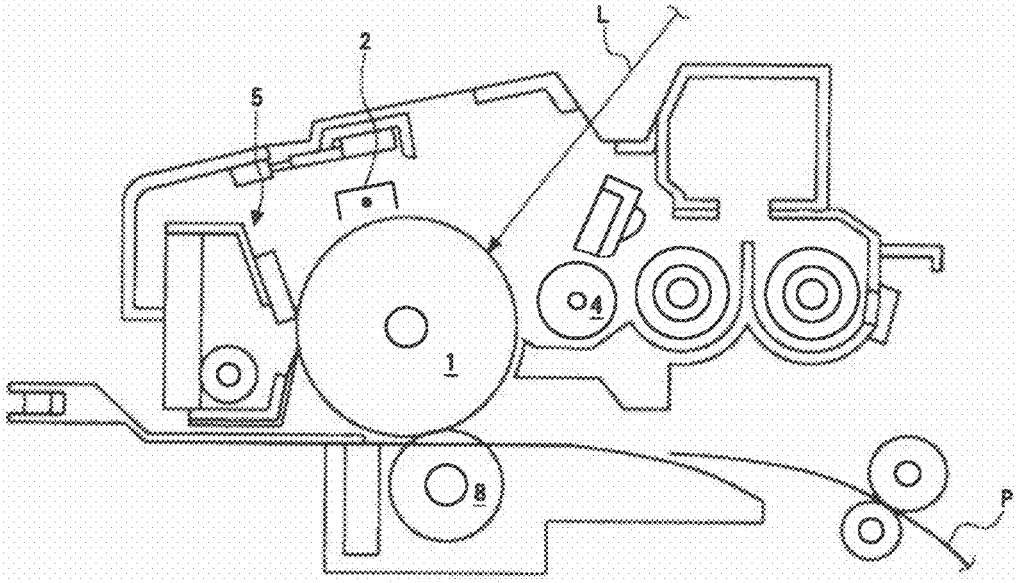
FIG. 6 is an explanatory view showing a process cartridge in which a toner of the present invention is used.

The process cartridge, for example as shown in FIG. 6, houses a latent electrostatic image bearing member 1, contains a charging unit 2, a developing unit 4, a transfer unit 8, and a cleaning unit 5, and further contains other units as required. In FIG. 6, L indicates exposure light from an exposing unit, and P indicates recording paper. For the latent image bearing member 1 of the process cartridge, a latent image bearing member similar to latent image bearing members which is used in an image forming apparatus can be used. The charging unit 2 can contain any charging member.

The following is a description of the image forming process by the process cartridge shown in FIG. 6. The latent electrostatic image bearing member 1 rotates in the direction as indicated by the arrow, the surface of the latent electrostatic image bearing member is charged with the charging unit 2 and exposed to exposure light L with the exposing unit (not shown), which results in the formation of a latent electrostatic image corresponding to the exposure image. The latent electrostatic image is developed with the developing unit 4 to form a toner image, which is then transferred to the recording paper P with the transfer unit 8 and a printout is thus produced. Then, the surface of the latent electrostatic image bearing member after image transfer is cleaned with the cleaning unit 5, and further discharged by a charge eliminating unit (not shown) to prepare for the next cycle of the operations described above.

EXAMPLES

Hereinafter, the present invention will be described in more detail by referring to Examples and Comparative Examples. However, the present invention may not be construed as being limited to these examples. Hereinafter, unless otherwise noted, "part(s)" and "%" represent "part(s) by mass" and "% by mass", respectively. First, methods for analyzing and evaluating toners obtained in Examples and Comparative Examples will be described.

In the following examples, the toner of the present invention is used as a one-component developer and evaluated. However, the toner of the present invention may also be used as a two-component developer by subjecting the toner to appropriate treatment with an external additive and adding an appropriate carrier to the toner.

Example 1

Synthesis of Polyester Containing Low Molecular Weight Vinyl Component (Synthesis of Hybrid Resin)

Styrene (St), butyl acrylate (n-BA), ethylhexyl acrylate (EHA), and acrylic acid (AA), as monomers for a vinyl resin, as well as dicumyl peroxide (DCP), as a polymerization initiator, were put in a dropping funnel, according to a formula shown in Table 1. Then, an ethylene oxide adduct of bisphenol A (BPA-EO) and a propylene oxide adduct of bisphenol A (BPA-PO) as alcohol monomers for a polyester resin, and adipic acid (APA) and terephthalic acid (TPA) as acid monomers for the polyester resin, as well as tin octylate as an esterification catalyst were put into a four-necked glass flask equipped with a thermometer, a stainless stirring stick, a downflow condenser, and a nitrogen inlet tube, according to a formula shown in Table 1. Then, into the four-necked flask containing alcohol monomers and acid monomers for the polyester resin and the esterification catalyst, the monomers for the vinyl resin and the polymerization initiator, which had been prepared previously, were dripped while the mixture was heated and stirred in a mantle heater in a nitrogen atmosphere. Subsequently, the addition polymerization reaction was matured at a predetermined temperature, and then the reaction mixture was allowed to undergo polycondensation reaction by increasing again the temperature of the reaction mixture. Note that the softening temperature of the reaction mixture was measured to monitor the progress of the reaction. The reaction was terminated when the softening temperature of the reaction mixture reached a predetermined temperature, and then the reaction mixture was cooled to room temperature to prepare polyester resins containing vinyl components as shown in Table 1, i.e., [low-molecular weight polyester L1] to [low-molecular weight polyester L5]. Note that the acid value (AV), the glass transition temperature (Tg), and the softening point (Tm) of the resultant vinyl component-containing polyester resins are shown in Table 1.

TABLE 1

| | L1 | L2 | L3 | L4 | L5 | L6 |
|---|---|---|---|---|---|---|
| Polyester component | | | | | | |
| BPA-PO [1] | 423 g | 419 g | 422 g | 432 g | 421 g | 450 g |
| BPA-EO [2] | 174 g | 167 g | 170 g | 160 g | 152 g | 200 g |
| Terephthalic acid | 224 g | 200 g | 215 g | 255 g | 222 g | 260 g |
| Adipic acid | 61 g | 40 g | 50 g | 50 g | 46 g | 60 g |
| Catalyst: tin octylate | 7 g | 5 g | 6 g | 6 g | 6 g | 12 g |
| Vinyl resin | | | | | | |
| Styrene | 85 g | 124 g | 102 g | 65 g | 114 g | |
| 2-Ethylhexyl acrylate | 15 g | 28 g | 20 g | 10 g | | |
| n-Butyl acrylate | | | | | 26 g | |
| Acrylic acid [3] | 7 g | 10 g | 9 g | 5 g | 6 g | |
| Polymerization initiator | | | | | | |
| Dicumyl peroxide | 4 g | 7 g | 6 g | 3 g | 7 g | |
| Softening point (° C.) | 105 | 95 | 101 | 100 | 111 | 100 |
| Glass transition temperature (° C.) | 55 | 49 | 55 | 55 | 69 | 57 |
| Acid value (mgKOH/g) | 22.7 | 15.8 | 19.4 | 26.3 | 21 | 25 |

[1] BPA-PO: Polyoxypropylene (2,2)-2,2bis(4-hydroxyphenyl) propane
[2] BPA-EO: Polyoxyethylene (2,2)-2,2bis(4-hydroxyphenyl) propane
[3] Monomer reactive in both types of polymerization reaction —Synthesis of Polyester (I)—

[Low-molecular weight polyester L6] which was an unmodified polyester resin was prepared by a method including at least polymerizing (polycondensating) a mixture in the same manner as in the above mentioned synthesis of hybrid resins except that vinyl components were not contained in the mixture, terminating the polymerization reaction when the softening temperature of the reaction mixture reach a predetermine temperature, and then cooling the temperature of the reaction mixture to room temperature.

—Synthesis of Isocyanate-Modified Polyester 1—

<Synthesis of Prepolymer>

Into a reaction container equipped with a cooling tube, a stirrer, and a nitrogen inlet tube, 366 parts of 1,2-propyleneglycol, 566 parts of terephthalic acid, 44 parts of trimellitic anhydride, and 6 parts of titanium tetrabutoxide were put, and the mixture was reacted under a normal pressure at 230° C. for 8 hr. Then it was further reacted under a reduced pressure of 10 mmHg to 15 mm Hg for 5 hr to prepare [Intermediate polyester 1]. The resultant [Intermediate polyester 1] had a number average molecular weight of 3,200, a weight average molecular weight of 12,000, and a glass transition temperature (Tg) of 55° C.

Next, into a reaction container equipped with a cooling tube, a stirrer, and a nitrogen inlet tube, 420 parts of [Intermediate polyester 1], 80 parts of isophoronediisocyanate, and 500 parts of ethyl acetate were put, and the mixture was reacted at 100° C. for 5 hr to prepare [Prepolymer]. The resultant [Prepolymer] contained 1.34% of free isocyanate therein.

(Master Batch 1)

Forty parts of a carbon black (REGAL 400R, manufactured by Cabot Corporation), 60 parts of a polyester resin (RS-801, manufactured by Sanyo Chemical Industries, Ltd.; acid value: 10 mgKOH/g, weight average molecular weight (Mw): 20,000, and glass transition temperature (Tg): 64° C.) as a binder resin, and 30 parts water were mixed in a henschel mixer to prepare a mixture containing pigment agglomerates each impregnated with water. The mixture was kneaded for 45 minutes with a two-roll kneader, in which the temperature of the surface of each roll had been set at 130° C., and the kneaded product was pulverized by a pluverizer to have a particle size of 1 mm, to thereby prepare [Master batch 1].

<Production of Pigment/Wax Dispersion Liquid (Oil Phase)>

Into a container equipped with a stirring bar and a thermometer, 545 parts of [polyester 1], 85 parts of paraffin wax (position and half-value width of endothermic peak as detected with a thermal analysis instrument (differential scanning calorimeter (DSC)): 73.1° C. and 3.9° C., respectively), and 1,450 parts of ethyl acetate were placed, and temperature of the mixture was increased to 80° C. while stirring, and then kept at 80° C. for 5 hr, and finally decreased to 30° C. in a time period of 1 hr. Subsequently, 500 parts of [master batch 1] and 100 parts of ethyl acetate were put into the container, and the mixture was mixed for 1 hr to prepare [Raw material solution 1].

To a container, 1,500 parts of [Raw material solution 1] was transferred, and the carbon black and the wax of [Raw material solution 1] were dispersed using a beads mill (ULTRA VISCO MILL, manufactured by Aimex Co., Ltd.; dispersing conditions are as follows, solution sending speed: 1 kg/hr, circumferential speed of a disk: 6 m/s, size of zirconia beads: 0.5 mm, filling rate with beads: 80% by volume, and number of passes: 3 times). Subsequently, 425 parts of [Polyester L1] and 230 parts of ethyl acetate were incorporated into the resultant dispersion, and the resultant mix was subjected to the beads mill for one pass under the same dispersing conditions as above to prepare [Pigment/wax dispersion 1]. The solid content of the resultant [Pigment/wax dispersion 1] was adjusted to 50% by mass with addition of ethyl acetate.

Production of Shell Resin

<Production Method of Resin Dispersion 1>

Into a reaction container equipped with a cooling tube, a stirrer, and a nitrogen inlet tube, 0.7 parts of sodium dodecyl sulfate and 498 parts of ion-exchange water were put, and the sodium dodecyl sulfate was dissolved in the ion exchange water by heating the mixture at 80° C. while stirring. Subsequently, to the resultant solution, a solution in which 2.6 parts of potassium persulfate were dissolved in 104 parts ion-exchange water was added, and 15 min after a monomer mixture of 140 parts of styrene monomer and 60 parts of methoxydiethyleneglycol methacrylate was dripped into the resultant solution in a time period of 90 min. Then, the resultant mixture was subjected to polymerization by further keeping the temperature thereof at 80° C. for 60 min, and finally the resultant reaction product was cooled to prepare white [Resin dispersion 1] which has a volume average particle diameter of 133 nm.

Production of Shell Resin

<Production Method of Resin Dispersion 2>

Into a reaction container equipped with a cooling tube, a stirrer, and a nitrogen inlet tube, 0.7 parts of sodium dodecyl sulfate and 498 parts of ion-exchange water were put, and sodium dodecyl sulfate was dissolved in ion exchange water by heating the mixture at 80° C. while stirring. Subsequently, to the resultant solution, a solution in which 2.6 parts of potassium persulfate were dissolved in 104 parts of ion-exchange water was added, and 15 min after, a monomer mixture of 140 parts of styrene monomer and 60 parts of methoxynonaethyleneglycol methacrylate was dripped into the resultant solution in a time period of 90 min. Then, the resultant mixture was subjected to polymerization by further keeping the temperature of the reaction mixture at 80° C. for 60 min, and finally the resultant reaction product was cooled to prepare white [Resin dispersion 2] which has a volume average particle diameter of 124 nm.

Production of Shell Resin

<Production Method of Resin Dispersion 3>

Into a reaction container equipped with a cooling tube, a stirrer, and a nitrogen inlet tube, 0.7 parts of sodium dodecyl sulfate and 498 parts of ion-exchange water were put, and the sodium dodecyl sulfate was dissolved in the ion exchange water by heating the mixture at 80° C. while stirring. Subsequently, to the resultant solution, a solution in which 2.6 parts of potassium persulfate were dissolved in 104 parts ion-exchange water was added, and 15 min after, a monomer mixture of 140 parts of styrene monomer and 60 parts of ethoxytriethyleneglycol methacrylate was dripped into the resultant solution in a time period of 90 min. Then, the resultant mixture was subjected to polymerization by further keeping the temperature of the mixture at 80° C. for 60 min, and finally the resultant reaction product was cooled to prepare white [Resin dispersion 3] which has a volume average particle diameter of 115 nm.

Production of Shell Resin

<Production Method of Resin Dispersion 4>

Into a reaction container equipped with a cooling tube, a stirrer, and a nitrogen inlet tube, 0.7 parts of sodium dodecyl sulfate and 498 parts of ion-exchange water were put, and the sodium dodecyl sulfate was dissolved in the ion exchange water by heating the mixture at 80° C. while stirring. Subsequently, to the resultant solution, a solution in which 2.6 parts of potassium persulfate was dissolved in 104 parts of ion-exchange water was added, and 15 min after, a monomer mixture of 200 parts of styrene monomer and 4.2 parts of octane thiol was dripped into the resultant solution in a time period of 90 min. Then, the resultant mixture was subjected to polymerization by further keeping the temperature of the mixture at 80° C. for 60 min, and finally the resultant reaction product was cooled to prepare white [Resin dispersion 4] which has a volume average particle diameter of 135 nm.

<Preparation of Water Phase>

Ion exchange water (990 parts), 40 parts of a 25% by mass aqueous dispersion of styrene-methacrylate-butyl acrylate-sodium methacrylate ethyleneoxide adduct sulfate copolymer (organic resin particles used for dispersion stability), 145 parts of a 48.5% aqueous solution of sodium dodecyl diphenyl ether disulfonate (ELEMINOL MON-7, manufactured by Sanyo Chemical Industries, Ltd.), and 95 parts of ethyl acetate were mixed while stirring to prepare a pale yellow liquid which was referred to as [Water phase 1].

<Emulsification>

[Pigment/wax dispersion 1] (975 parts), and 2.7 parts of isophoronediamine were mixed for one min using TK HOMO MIXER (manufactured by Primix Corporation) at 5,000 rpm. To the resultant mixture, 77 parts of [isocyanate-modified polyester 1] ([Prepolymer]) was further added and mixed for one min using the TK HOMO MIXER (manufactured by Primix Corporation) at 5,000 rpm. Subsequently, to the resultant mixture, 1,200 parts of [Water phase 1] was added and mixed for 20 min using the TK HOMO MIXER at 8,000 rpm to 13,000 rpm to prepare [Emulsification slurry 1].

<Formation of Shell>

While mixing [Emulsification slurry 1] with the TK HOMO MIXER at 300 rpm to 500 rpm, 5 parts of [Resin dispersion 1] was dripped into [Emulsification slurry 1]. Ten minutes after the dripping, the resultant mixture was diluted 1.4-fold with ion-exchange water to prepare [Mixed liquid 1].

<Desolvation>

[Mixed liquid 1] was put into a container equipped with a stirrer and a thermometer, and subjected to desolvation for 8 hr at 30° C. to prepare [Dispersion slurry 1].

<Washing and Drying>

The resultant [Dispersion slurry 1] (100 parts) was filtered under reduced pressure, and the resultant filter cake was washed and dried in the following manner:

(1) Ion exchange water (100 parts) was added to the filter cake, and the resultant slurry was mixed using TK HOMO MIXER (for 10 min at 12,000 rpm) and then filtrated.

(2) Ion exchange water (900 parts) was added to the filter cake prepared in (1), and the resultant slurry was mixed using TK HOMO MIXER (for 30 min at 12,000 rpm) while applying ultrasonic vibration thereto. The resultant mixture was filtered under reduced pressure. These operations were repeated until the electroconductivity of the reslurry liquid became 10 μS/cm or lower.

(3) Hydrochloric acid (concentration of 10% by mass) was added to the resultant reslurry liquid until the pH of the reslurry liquid became 4. Then the pH adjusted reslurry liquid was stirred using Three-One Motor for 30 min and then filtered.

(4) Ion exchange water (100 parts) was added to the filter cake prepared in (3), and the resultant slurry was mixed using TK HOMO MIXER (for 10 min at 12,000 rpm). Then the resultant mixture was filtered at reduced pressure. These operations were repeated until the electroconductivity of the reslurry liquid became 10 μS/cm or lower to prepare [Filter cake 1].

The resultant [Filter cake 1] was dried at 42° C. for 48 hr using an air circulation dryer, and the resultant [Filter cake 1] was sieved through a mesh with an opening having a size of 75 μm to prepare [Toner base material 1] which had an average circularity of 0.976, a volume average particle diameter (Dv) of 6.2 μm, and a number average particle diameter (Dp) of 5.8 μm.

Example 2

[Toner base material 2] was produced in the same manner as in Example 1, except that hybrid resin L2 and the [Prepolymer] were used for the core.

Example 3

[Toner base material 3] was produced in the same manner as in Example 1, except that hybrid resin L3 and the [Prepolymer] were used for the core.

Example 4

[Toner base material 4] was produced in the same manner as in Example 1, except that hybrid resin L4 and the [Prepolymer] were used for the core.

Example 5

[Toner base material 5] was produced in the same manner as in Example 1, except that hybrid resin L5 and the [Prepolymer] were used for the core.

Example 6

[Toner base material 6] was produced in the same manner as in Example 1, except that hybrid resin L6 and the [Prepolymer] were used for the core.

Example 7

[Toner base material 7] was produced in the same manner as in Example 1, except that hybrid resin L1 and the [Prepolymer] were used for the core and that [Resin dispersion 2] was used for the shell.

Example 8

[Toner base material 8] was produced in the same manner as in Example 1, except that hybrid resin L1 and the [Prepolymer] were used for the core and that [Resin dispersion 3] was used for the shell.

Example 9

Production Example of Dissolution Suspension Method

[Toner base material 9] was produced in the same manner as in Example 1, except that toner base material was produced without using the isocyanate-modified polyester ([Prepolymer]) in the emulsification and that [Resin dispersion 1] was used for the shell (only the hybrid resin was used for the core).

Example 10

Production Example of Dissolution Suspension Method

[Toner base material 10] was produced in the same manner as in Example 9, except that hybrid resin L2 was used for the hybrid resin used in the core.

Example 11

Production Example of Dissolution Suspension Method

[Toner base material 11] was produced in the same manner as in Example 9, except that polyester resin L6 was used for the polyester used in the core.

Comparative Example 1

[Toner base material 12] was produced in the same manner as in Example 1, except that hybrid resin L1 and the [Prepolymer] were used for the core and that [Resin dispersion 4] was used for the shell.

Comparative Example 2

[Toner base material 13] was produced in the same manner as in Example 1, except that hybrid resin L1 was used for the core and [Resin dispersion 4] was used for the shell.

Comparative Example 3

[Toner base material 14] was produced in the same manner as in Example 1, except that hybrid resin L1 and the [Prepolymer] were used for the core and that the shell was not produced.

Comparative Example 4

[Toner base material 15] was produced in the same manner as in Example 1, except that hybrid resin L1 was used for the core and that the shell was not produced.

Comparative Example 5

[Toner base material 16] was produced in the same manner as in Example 1, except that polyester resin L6 was used for the core and that the shell was not produced.

Toners thus produced in Examples 1 to 11 and Comparative Examples 1 to 5 were analyzed and evaluated as follows. Results are shown in Tables 2 and 3.

<Method for Measurement>

(Particle Diameter)

The procedure for determining a toner particle size distribution is described.

COULTER COUNTER TA-II or COULTER MULTISIZER II (both manufactured by Coulter Company Limited) may be used for determining a size distribution of toner particles according to a coulter counter method. The method for determining a size distribution is as follows.

First, into 100 mL to 150 mL of an aqueous electrolyte solution, 0.1 mL to 5 mL of a surfactant (i.e. alkylbenzene sulfonate salt) was added as a dispersant. The electrolyte solution was a 1% aqueous NaCl solution (using first-grade sodium chloride), for which ISOTON-II (manufactured by Coulter Company Limited) could be used. Then, a measurement sample containing 2 mg to 20 mg of solid contents was further dispersed in the aqueous electrolyte solution, and the aqueous electrolyte solution in which the measurement sample had been suspended was subjected to a dispersing treatment using an ultrasonic dispersing device for 1 min to 3 min. The resulting sample-suspending electrolyte solution was analyzed using the above analyzer with 100 μm apertures to determine the volume and number of a toner or a toner particle to calculate the volume distribution and the number distribution, from which the volume-average particle diameter (Dv) and the number-average particle diameter (Dp) of the toner or the toner particle were calculated.

For example, particles having a diameter of 2.00 μm to below 40.30 μm can be analyzed by using a total of 13 channels, e.g., 2.00 μm to below 2.52 μm, 2.52 μm to below 3.17 μm, 3.17 μm to below 4.00 μm, 4.00 μm to below 5.04 μm, 5.04 μm to below 6.35 μm, 6.35 μm to below 8.00 μm, 8.00 μm to below 10.08 μm, 10.08 μm to below 12.70 μm, 12.70 μm to below 16.00 μm, 16.00 μm to below 20.20 μm, 20.20 μm to below 25.40 μm, 25.40 μm to below 32.00 μm and 32.00 μm to below 40.30 μm in size.

(Average Circularity)

For a shape measurement method, a method using an optical detection band was suitable used. In this method, a particle-containing suspension was passed through a detection band in a photographing section set on a plane, and particles images were optically detected and analyzed by a CCD camera. An average circularity of particles of interest was defined as a value obtained by dividing a peripheral length of a circle having the same projection area as the projection area of the particle of interest by the actual particle peripheral length of the particle of interest, as quantified using the above equipment.

This value was a value measured as an average circularity by means of a flow type particle image analyzer, FPIA-2000. Specifically, to 100 mL to 150 mL of water from which solid impurities had been removed beforehand, 0.1 mL to 0.5 mL of a surfactant (i.e. alkylbenzene sulfonate) was added as a dispersant, and then about 0.1 g to about 0.5 g of the sample was further added. The resultant suspension in which the sample had been dispersed was subjected to dispersing treatment using an ultrasonic dispersing device for about 1 min to about 3 min to adjust the concentration of the dispersion to 3,000 particles/μL to 10,000 particles/A. Thus, the shape and the distribution of a toner were determined using the above-mentioned analyzer.

(Volume Average Particle Diameter of Fine Resin Particles)

The volume average particle diameter of fine resin particles was measured using NANOTRAC PARTICLE SIZE ANALYZER (UPA-EX150, manufactured by NIKKISO CO., LTD., using a Dynamic Light Scattering method/Laser Doppler method). Specifically, the concentration of the fine resin particles in the dispersion liquid was adjusted to the range of concentrations where volume average particle diameters were measurable. Note that, before the adjustment, a dispersion medium of the dispersion was subjected to the measurement as a background measurement. According to this measurement method, it is possible to measure volume average particle diameters in the range of several tens nm to several μm, which is the range of volume average particle diameters of fine resin particles used in the present invention.

(Molecular Weight)

The molecular weights of the polyester resin or vinyl copolymer resin, and hybrid resin for use were measured by common GPC (gel permeation chromatography) under the following measuring conditions:

Device: HLC-8220GPC (manufactured by TOSOH CORPORATION)

Column: TSK gel SuperHZM-Mx3

Temperature: 40° C.

Solvent: THF (tetrahydrofuran)

Flow rate: 0.35 mL/min

Sample; 0.01 mL of a sample having a concentration of 0.05% to 0.6%

Weight average molecular weight Mw was calculated based on a molecular weight distribution of a toner resin determined by GPC carried out under the above conditions using monodisperse polystyrene standards for constructing a molecular weight calibration curve. For the monodisperse polystyrene standards, 10 monodisperse polystyrene standards each having the following molecular weight were used: 5.8×100, 1.085×10,000, 5.95×10,000, 3.2×100,000, 2.56×1,000,000, 2.93×1,000, 2.85×10,000, 1.48×100,000, 8.417×100,000, and 7.5×1,000,000.

(Glass Transition Temperature)

Glass transition temperatures of the polyester resin and the vinyl-based copolymer resin for use were each determined using a differential scanning calorimeter (DSC-6220R, manufactured by Seiko Instruments Inc.), where a sample was heated from room temperature to 150° C. at a temperature increasing rate of 10° C./min, the temperature of the sample was held at 150° C. for 10 min, and then the sample was cooled to room temperature, at which it was again held for 10 min. Then, the sample was again heated from room temperature to 150° C. at a temperature increasing rate of 10° C./min. The glass transition temperature was defined as a temperature at which a shoulder occurred between two baselines in a DSC curve, wherein a baseline below the glass transition temperature had a height two times higher than the height of a baseline beyond the glass transition temperature.

(Surface Profile of Toner)

Toner base materials of Example 1 and Comparative Example 1 were observed using an electromicroscope (S-4800, manufactured by Hitachi, Ltd.; acceleration voltage: 5 kV, magnification of ×5,000) and photographs of Example 1 (FIG. 1A) and Comparative Example 1 (FIG. 1B) were taken using the same.

The results of the particle diameter, average circularity, molecular weight, and glass transition temperature of the toners of Examples 1 to 11 and Comparative Examples 1 to 5 are shown in Table 2.

TABLE 2

| | Particle diameter (μm) | average circularity | weight-average molecular weight | Glass transition temperature (° C.) |
|---|---|---|---|---|
| Example 1 | 6.5 | 0.984 | 12500 | 56 |
| Example 2 | 6.2 | 0.983 | 13000 | 50 |
| Example 3 | 6.4 | 0.985 | 13500 | 57 |
| Example 4 | 6.5 | 0.983 | 12600 | 55 |
| Example 5 | 6.4 | 0.984 | 12000 | 68 |
| Example 6 | 6.3 | 0.986 | 12700 | 58 |
| Example 7 | 6.6 | 0.985 | 12400 | 59 |
| Example 8 | 6.4 | 0.984 | 11500 | 57 |
| Example 9 | 6.2 | 0.986 | 10500 | 55 |
| Example 10 | 6.0 | 0.987 | 10000 | 50 |
| Example 11 | 6.3 | 0.987 | 9800 | 57 |
| Comparative Example 1 | 6.4 | 0.986 | 14000 | 58 |
| Comparative Example 2 | 6.6 | 0.987 | 11000 | 56 |
| Comparative Example 3 | 6.4 | 0.984 | 14000 | 56 |
| Comparative Example 4 | 6.5 | 0.985 | 10000 | 55 |
| Comparative Example 5 | 6.2 | 0.984 | 9500 | 58 |

(Scumming of Photoconductor with Toner)

A predetermined print pattern having a coverage rate of 6% was printed using an image forming apparatus (IPSIO SPC220, manufactured by Ricoh Co., Ltd.) in an atmosphere of normal temperature and normal humidity (an N/N environment) (23° C., 45% RH). L* of the toner deposited on the photoconductor was determined by a tape transfer method at the initial period of printing and also after printing of 10,000 sheets. In the tape transfer method, a strip of a mending tape (manufactured by Sumitomo 3M Limited) was stacked on the residual toner remaining on the photoconductor so as to transfer the residual toner onto the mending tape strip, and then the tape strip bearing the residual toner thereon and a tape strip which had not been stacked on the photoconductor were both stacked on white paper. The reflection densities of these tapes were measured by X-Rite 939, and a difference L* of these densities was determined as a reflection density of the scamming on the photoconductor. The obtained value was evaluated based on the following criteria.

[Evaluation Criteria]

A: a rate of change of L* from initial period to after printing 10,000 sheets was 2% or less B: the rate of change of L* was 2% to 5%

C: the rate of change of L* was 5% or more

Note that the criteria of A and B were considered as acceptable levels.

(Blade Adhesion)

The state of a developing roller in a developing device and printed images were visually observed after a predetermined print pattern having a coverage rate of 6% was consecutively printed using an image forming apparatus (IPSIO SPC220, manufactured by Ricoh Co., Ltd.) in an atmosphere of normal temperature and normal humidity (N/N environment) (23° C., 45% RH) on 10,000 sheets of paper. The blade adhesion was evaluated based on the following criteria:

[Evaluation Criteria]

A: No cord nor unevenness found on the developing roller

B: A small amount of cord or unevenness found on the developing roller, no vertical streak found on copied images, practically having no problem C: A large amount of cord or unevenness found on the developing roller, some vertical streak of uncopied part found on copied images, practically problematic Note that the criteria of A and B were considered as acceptable levels.

(Filming)

The state of a photoconductor and an intermediate transfer belt were visually observed after a predetermined print pattern having a coverage rate of 6% has been consecutively printed using an image forming apparatus (IPSIO SPC220, manufactured by Ricoh Co., Ltd.) in an atmosphere of normal temperature and normal humidity (N/N environment) (23° C., 45% RH) on 10,000 sheets of paper. The filming was evaluated based on the following criteria:

[Evaluation Criteria]

A: No filming found on the photoconductor and the intermediate transfer belt

B: A small amount of filming found on either the photoconductor or the intermediate transfer belt, practically having no problem C: A large amount of cord or unevenness found on the photoconductor and/or the intermediate transfer belt, practically problematic The results of the scumming of photoconductor, blade adhesion, and filming of the toners of Examples 1 to 11 and Comparative Examples 1 to 5 are shown in Table 3.

TABLE 3

| | Core component | Shell component | Scumming of photoconductor | Blade adhesion | Filming |
|---|---|---|---|---|---|
| Ex. 1 | L1(Hybrid resin) + Prepolymer | Resin dispersion 1 | A | A | A |
| Ex. 2 | L2(Hybrid resin) + Prepolymer | Resin dispersion 1 | A | A | A |
| Ex. 3 | L3(Hybrid resin) + Prepolymer | Resin dispersion 1 | A | B | A |
| Ex. 4 | L4(Hybrid resin) + Prepolymer | Resin dispersion 1 | A | A | A |
| Ex. 5 | L5(Hybrid resin) + Prepolymer | Resin dispersion 1 | B | A | A |
| Ex. 6 | L6(Polyester resin) + Prepolymer | Resin dispersion 1 | A | B | A |
| Ex. 7 | L1(Hybrid resin) + Prepolymer | Resin dispersion 2 | A | B | A |
| Ex. 8 | L1(Hybrid resin) + Prepolymer | Resin dispersion 3 | A | B | A |
| Ex. 9 | L1(Hybrid resin) | Resin dispersion 1 | A | A | A |
| Ex. 10 | L2(Hybrid resin) | Resin dispersion 1 | A | A | A |
| Ex. 11 | L6(Polyester resin) | Resin dispersion 1 | A | B | A |
| Comp. Ex. 1 | L1(Hybrid resin) + Prepolymer | Resin dispersion 4 | B | C | B |
| Comp. Ex. 2 | L1(Hybrid resin) | Resin dispersion 4 | B | C | B |
| Comp. Ex. 3 | L1(Hybrid resin) + Prepolymer | Without shell | C | C | B |
| Comp. Ex. 4 | L1(Hybrid resin) | Without shell | C | C | B |
| Comp. Ex. 5 | L6(Polyester resin) | Without shell | C | C | C |

The toner of the present invention may provide high quality images without causing blade adhesion as well as image noises such as filming and background fogging, thus may be used for an electrophotographic toner for use in copiers, printers, facsimiles, and the complex machines thereof, which operate according to electrophotographic methods.

What is claimed is:

1. A toner comprising:

a binder resin, a colorant, and a releasing agent, wherein the toner has a core-shell structure, and wherein the core contains at least one resin selected from the group consisting of a hybrid resin or a resin mixture of the hybrid resin and a polyester resin, where the hybrid resin is a resin in which a polyester resin and a vinyl resin are chemically bonded to each other, and wherein the hybrid resin contains a styrene resin in an amount of 5% by mass to 25% by mass based on the total amount of the hybrid resin during synthesis thereof, and the shell contains a resin prepared by polymerizing at least a styrene monomer and an ester monomer represented by the following General Formula (1):

General Formula (1)

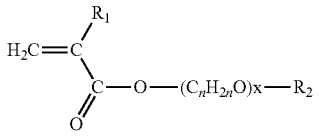

where, 'n' is 2, 'X' is any of 2 to 9, $R_1$ is a hydrogen atom, or an alkyl group, and $R_2$ is a hydrogen atom, or an alkyl group.

2. The toner according to claim 1, wherein the resin contained in the shell contains 65% by mass to 85% by mass of a styrene monomer and 15% by mass to 35% by mass of an ester monomer based on the total amount of monomers in the resin, and the total amount of the styrene monomer and the ester monomer is 80% by mass to 100% by mass based on the total amount of the monomers in the resin.

3. The toner according to claim 1, wherein the resin contained in the shell contains 70% by mass to 80% by mass of a styrene monomer and 20% by mass to 30% by mass of an ester monomer based on the total amount of monomers in the resin, and the total amount of the styrene monomer and the ester monomer is 90% by mass to 100% by mass based on the total amount of the monomers in the resin.

4. The toner according to claim 1, wherein the hybrid resin contains a styrene resin in an amount of 10% by mass to 20% by mass based on the total amount of the hybrid resin during synthesis thereof.

5. The toner according to claim 1, wherein the core further contains a polyester resin modified with at least one of a urethane group and a urea group, in addition to the resin having a polyester backbone.

6. The toner according to claim 1, wherein the releasing agent contains at least one selected from the group consisting of paraffin, synthetic polyester, polyolefin, carnauba wax, and rice wax.

7. A toner container comprising:

a container, and a toner housed in the container, wherein the toner is a toner as claimed in claim 1.

8. A developer comprising:

a toner, wherein the toner is the toner as claimed in claim 1.

9. A developing device comprising:

a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner as claimed in claim 1.

10. A process cartridge comprising:

a latent image bearing member, and a developing device configured to develop a latent image formed on the latent image bearing member with a developer, wherein the latent image bearing member is integrated with at least the developing device so as to form the process cartridge which is detachably mounted on an image forming apparatus, wherein the developing device contains, a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner as claimed in claim 1.

11. An image forming apparatus comprising, a latent image bearing member configured to bear a latent image on a surface thereof, a charging unit configured to evenly charge the surface of the latent image bearing member, an exposing unit configured to expose the charged surface of the latent image bearing member to light based on an image data so as to write the latent electrostatic image thereon, a developing device configured to supply a toner to the latent electrostatic image formed on the surface of the latent image bearing member so as to visualize the latent electrostatic image, a transfer unit configured to transfer the resultant visible image formed on the surface of the latent image bearing member to a medium, and a fixing unit configured to fix the resultant visible image on the medium, wherein the developing device contains, a developer bearing member configured to bear on a surface thereof a developer to be supplied to a latent image bearing member, a developer supplying member configured to supply the developer to the surface of the developer bearing member, and a developer container configured to contain the developer, wherein the developer container contains a developer which contains a toner as claimed in claim 1.

* * * * *